US012760506B2

(12) United States Patent
Thyroff

(10) Patent No.: US 12,760,506 B2
(45) Date of Patent: Oct. 13, 2026

(54) TOILET CLEANING SYSTEM

(71) Applicant: Louis E. Thyroff, Pittsford, NY (US)

(72) Inventor: Louis E. Thyroff, Pittsford, NY (US)

( * ) Notice: Subject to any disclaimer, the term of this patent is extended or adjusted under 35 U.S.C. 154(b) by 143 days.

(21) Appl. No.: 18/908,269

(22) Filed: Oct. 7, 2024

(65) Prior Publication Data

US 2025/0101726 A1 Mar. 27, 2025

Related U.S. Application Data

(63) Continuation-in-part of application No. 18/512,908, filed on Nov. 17, 2023, now Pat. No. 12,559,924.

(60) Provisional application No. 63/662,439, filed on Jun. 21, 2024, provisional application No. 63/426,062, filed on Nov. 17, 2022.

(51) Int. Cl.

| | |
|---|---|
| ***E03D 1/28*** | (2006.01) |
| ***E03D 3/10*** | (2006.01) |
| ***E03D 11/11*** | (2006.01) |

(52) U.S. Cl.

CPC ..... *E03D 1/286* (2013.01); *E03D 3/10* (2013.01); *E03D 11/11* (2013.01); *E03D 2201/40* (2013.01)

(58) Field of Classification Search

CPC ..... E03D 1/286; E03D 3/10; E03D 11/11; E03D 201/40

USPC ..... 4/332

See application file for complete search history.

(56) References Cited

U.S. PATENT DOCUMENTS 633,390 A 9/1899 Schell
685,020 A 10/1901 Venners
1,127,207 A 2/1915 Doran
2,171,734 A * 9/1939 Schmiedeknecht ..... E03C 1/10 137/112
2,993,214 A 7/1961 Franco
(Continued)

FOREIGN PATENT DOCUMENTS

| | | |
|---|---|---|
| EP | 0960984 A2 | 12/1999 |
| EP | 3148389 B1 | 2/2021 |
| WO | WO2009105417 A1 | 8/2009 |

OTHER PUBLICATIONS

International Search Report and Written Opinion of the International Searching Authority for PCT/US24/80311 (Apr. 12, 2024) Apr. 2024.

*Primary Examiner* — Huyen D Le
(74) *Attorney, Agent, or Firm* — Michael J. Nickerson

(57) ABSTRACT

A flush valve adapter for a tankless toilet having a flush valve housing and a vacuum breaker member includes a conduit body having a first end and a second end; a female threaded interface located at the first end of the conduit body; a male threaded interface located at the second end of the conduit body; and an outlet port member located in the conduit body between the female threaded interface and the male threaded interface. A vacuum breaker adapter for a tankless toilet having a flush valve housing includes a conduit body having a first end and a second end; a female threaded interface located at the first end of the conduit body; a vacuum breaker mechanism located at the first end of the conduit body; an inlet port member located in the conduit body between the vacuum breaker mechanism and the second end of the conduit body; and a cleaning agent mixing chamber interface member located on the conduit body between the vacuum breaker mechanism and the inlet port member.

28 Claims, 24 Drawing Sheets

(56) References Cited

U.S. PATENT DOCUMENTS

| | | | | |
|---|---|---|---|---|
| 3,228,040 | A | | 1/1966 | Currie |
| 3,290,698 | A | | 12/1966 | Joyner et al. |
| 3,769,640 | A | | 11/1973 | Castronovo |
| 3,890,657 | A | | 6/1975 | Gray |
| 4,841,578 | A | * | 6/1989 | Mercer ..... E03D 9/02 4/225.1 |
| 4,993,084 | A | | 2/1991 | McCauley et al. |
| 5,603,126 | A | | 2/1997 | Scoggins |
| 5,774,903 | A | | 7/1998 | Wilson et al. |
| 5,881,396 | A | | 3/1999 | Rivera |
| 6,240,572 | B1 | | 6/2001 | Van Der Gaag et al. |
| 6,449,779 | B1 | | 9/2002 | Nguyen |
| 6,662,379 | B2 | | 12/2003 | Nguyen et al. |
| 6,662,380 | B1 | | 12/2003 | Leonard et al. |
| 8,136,171 | B2 | | 3/2012 | Huang |
| 11,131,087 | B2 | | 9/2021 | Sonovani |
| 11,873,634 | B2 | | 1/2024 | Kuru et al. |
| 2002/0116752 | A1 | | 8/2002 | Nguyen |
| 2004/0117899 | A1 | | 6/2004 | Nguyen et al. |
| 2005/0204459 | A1 | | 9/2005 | Selenke |
| 2007/0289054 | A1 | | 12/2007 | Han et al. |
| 2009/0013457 | A1 | | 1/2009 | Microchnik |
| 2011/0219525 | A1 | | 9/2011 | Burt et al. |
| 2017/0058500 | A1 | | 3/2017 | Garrels et al. |
| 2018/0305913 | A1 | | 10/2018 | Ciaccio |
| 2019/0360187 | A1 | | 11/2019 | Aldridge |
| 2019/0360189 | A1 | | 11/2019 | Holguin |

* cited by examiner

TOILET CLEANING SYSTEM

PRIORITY INFORMATION

This application is a continuation-in-part of U.S. patent application, Ser. No. 18/512,908, filed on Nov. 17, 2023. The entire content of U.S. patent application, Ser. No. 18/512,908, filed on Nov. 17, 2023, is hereby incorporated by reference.

This application claims priority, under 35 U.S.C. § 120 from U.S. patent application, Ser. No. 18/512,908, filed on Nov. 17, 2023, said U.S. patent application, Ser. No. 18/512,908, filed on Nov. 17, 2023 claiming priority from U.S. Provisional Patent Application, Ser. No. 63/426,062, filed on Nov. 17, 2022.

This application claims priority from U.S. Provisional Patent Application, Ser. No. 63/426,062, filed on Nov. 17, 2022. The entire content of U.S. Provisional Patent Application, Ser. No. 63/426,062, filed on Nov. 17, 2022, is hereby incorporated by reference.

This application claims priority from U.S. Provisional Patent Application, Ser. No. 63/662,439, filed on Jun. 21, 2024. The entire content of U.S. Provisional Patent Application, Ser. No. 63/662,439, filed on Jun. 21, 2024, is hereby incorporated by reference.

BACKGROUND

Cleaning systems for toilets typically include a cleaning agent composed of water-soluble material formed into a tablet. The tablet is commonly disposed in the toilet bowl or the toilet tank. When placed in the toilet bowl, the cleaning agent is coupled to an interior of the bowl by supporting means, such as wires. Since a cleaning agent must be capable of dissolving quickly due to the short duration in which passing water makes contact with the agent, such cleaning agents get used quickly. This requires the frequent replacement of the supporting means. Since the supporting means is located in the toilet bowl, manual replacement can be messy and undesirable.

Cleaning agents, such as tablets, for placement in a toilet tank are also adapted to dissolve quickly. This results in the release of fumes and various other gases which can cause damage to the plumbing of toilet tank. Cleaning agents placed inside the tank are adapted to be dissolved by a large volume of water, which volume passes through with each flush. As a result, much of the cleaning agent is wasted, thereby requiring frequent replacement.

Cleaning agents, provided in the form of cleanser tablets, for example, may contain chemicals which are harmful upon direct contact with human skin and eyes. Replacement cleanser tablets, which are commonly sold separately, require the user to make direct contact as the tablet is removed from its packaging and placed into a dispenser.

Furthermore, common cleanser tablets which are often brightly colored may tempt younger children to touch or even ingest the cleaning agent, especially if placed in the toilet bowl where a child can gain access.

A prior art solution to the issues discussed above is disclosed in Published US Patent Application Number 2004/0117899-A1. The entire content of Published US Patent Application Number 2004/0117899-A1 is hereby incorporated by reference.

More specifically, FIG. 1 of Published US Patent Application Number 2004/0117899-A1 illustrates a prior art solution to the issues discussed above. FIG. 1 is a perspective view of a toilet tank assembly 10 employing a dispenser system 20. The dispenser assembly 20 is coupled to a fill valve 24 and an overflow tube 28. A fill tube 22 extends from the fill valve 24 to the dispenser system 20. An outflow tube 26 is coupled to the dispenser system 20 and the overflow tube 28.

The dispenser system 20 is adapted for placement within a toilet tank 31. The dispenser system 20 includes a hanger 33 configured to hang from a rear sidewall 35 of the tank 31. System 20 fits conveniently within tank 31.

Published US Patent Application Number 2004/0117899-A1 further discloses that the dispenser housing includes an inlet port for receiving incoming liquid from the fill tube and an outlet port for directing fluid out through the outflow tube. The inlet port is disposed above the outlet port.

The dispenser system of Published US Patent Application Number 2004/0117899-A1 requires a user to remove the tablet cartridge from the dispensing housing to determine if the tablet is spent.

Moreover, the tablet cartridge fails to provide a clear visible path for determining the usable state of the enclosed tablet because the user must look through two sets of small apertures which must be aligned properly to provide a visible path to the enclosed tablet.

Additionally, the inlet trap of the dispenser system of Published US Patent Application Number 2004/0117899-A1 is filled with cleaning agent solution, thus allowing the cleaning agent solution to gas off and the corrosive cleaning agent gas to travel to the fill valve assembly and cause damage thereto.

Lastly, the partially spent tablet in the tablet cartridge is not easily accessible for replacement. More specifically, the user needs to turn the tablet cartridge upside down, and possibly shake the tablet cartridge, to remove the partially spent tablet from the tablet cartridge.

With respect to commercial tankless toilets, every time a commercial tankless toilet is flushed, it releases billions of tiny water droplets into the air, forming aerosol plumes of contagious pathogens suspended and traveling up to 6.6 feet in a second, landing on surfaces, counters, soap, and faucet handles, and floors throughout the restroom. Larger particles that settle quickly on surfaces can spread diseases through contact with the hands and mouth. Micro aerosol plumes from tankless toilets can remain suspended typically in the air for 8-10 minutes, increasing the risk of inhaling pathogens.

Thus, it is desirable to provide a dispensing cleaning agent system that can dispense an appropriate cleaning agent into the flushing fluid of a commercial tankless toilet that can neutralize or kill the pathogens in the resulting plumes.

Furthermore, it is desirable to provide a dispensing cleaning agent system that can be easily integrated with a commercial tankless toilet.

Additionally, it is desirable to provide a dispensing cleaning agent system that can be easily integrated with a commercial tankless toilet and dispense an appropriate cleaning agent into the flushing fluid that can neutralize or kill the pathogens in the resulting plumes.

Also, it is desirable to provide a dispensing system that does not require a user to remove a tablet cartridge from a dispensing housing to determine if a tablet is spent.

Moreover, it is desirable to provide a dispensing system that provides a clear visible path for determining the usable state of the enclosed tablet.

Additionally, it is desirable to provide a dispensing system that provides a trap that traps clean incoming water to prevent any corrosive cleaning agent gas from travelling to the fill valve assembly and cause damage thereto.

Additionally, it is desirable to provide a dispensing system that enables a partially spent tablet to be easily accessible for replacement.

BRIEF DESCRIPTION OF THE DRAWINGS

The drawings are only for purposes of illustrating various embodiments and are not to be construed as limiting, wherein.

DETAILED DESCRIPTION OF THE DRAWINGS

Figure 1:
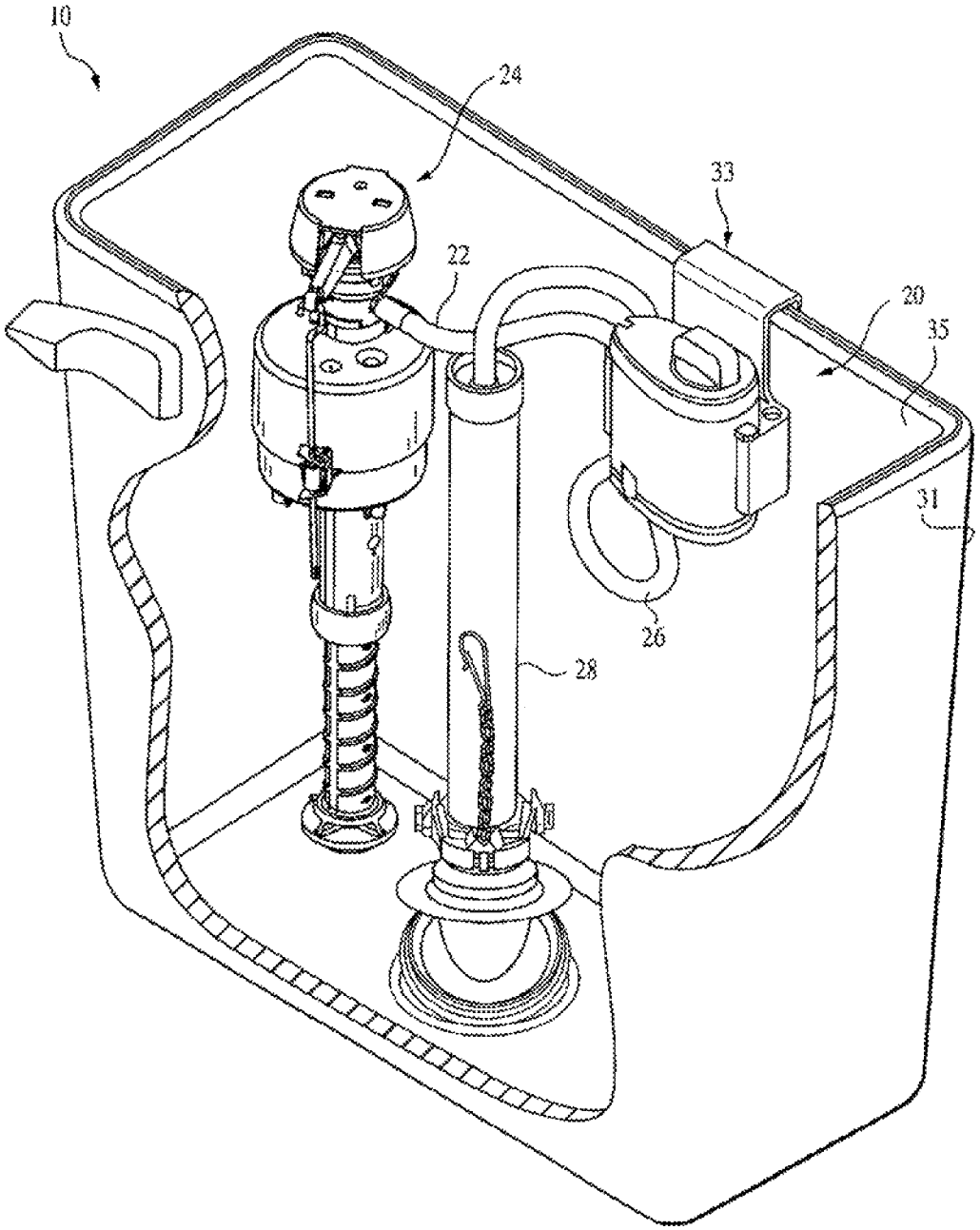
FIGURE 1 (PRIOR ART)
FIG. 1 illustrates a prior art cleaning agent dispensing system.

For a general understanding, reference is made to the drawings. In the drawings, like references have been used throughout to designate identical or equivalent elements. It is also noted that the drawings may not have been drawn to scale and that certain regions may have been purposely drawn disproportionately so that the features and concepts may be properly illustrated.

Figure 2:
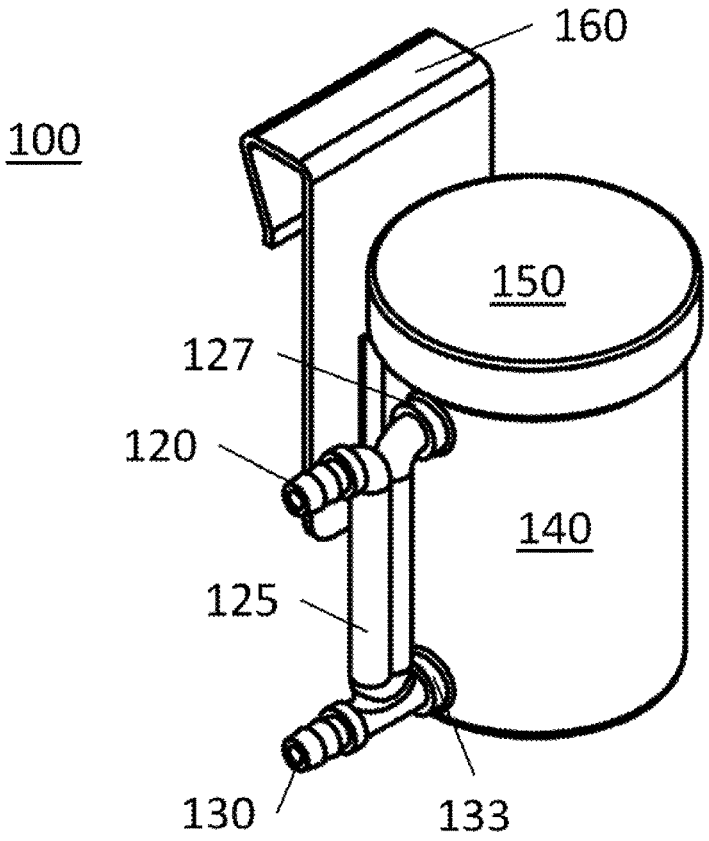
FIG. 2 illustrates a perspective view of an embodiment of an assembled cleaning agent dispensing system.

FIG. 2 illustrates a perspective view of an embodiment of an assembled cleaning agent dispensing system. As illustrated in FIG. 2, a cleaning agent dispensing system 100 includes a transparent cleaning agent mixing chamber 140 for mixing water with a cleaning agent tablet. The cleaning agent dispensing system 100 is configured to attach to a wall of a toilet water tank (not shown) via clip mechanism 160. The cleaning agent dispensing system 100 also includes a lid 150 configured to cover and seal the transparent cleaning agent mixing chamber 140.

The cleaning agent dispensing system 100 includes an inlet port 120 for receiving water from a fill valve (not shown) via a tube (not shown). The transparent cleaning agent mixing chamber 140 includes a mixing chamber inlet port 127 for enabling water received by the inlet port 120 to enter the transparent cleaning agent mixing chamber 140.

Between the inlet port 120 and the mixing chamber inlet port 127, a trap 125 is located to prevent gases from the cleaning agent solution or the cleaning agent solution, itself, from travelling back towards the fill valve (not shown).

The cleaning agent dispensing system 100 includes an outlet port 130 for outputting cleaning agent solution to an overflow tube (not shown) via a tube (not shown). The transparent cleaning agent mixing chamber 140 includes a mixing chamber outlet port 133 for enabling the cleaning agent solution in the transparent cleaning agent mixing chamber 140 to exit to the overflow tube (not shown).

Based upon the configuration of the mixing chamber inlet port and the mixing chamber outlet port, the trap remains filled with clean incoming water from the filler valve (not shown) after a flush operation, and the water remaining in trap 125, after the flush operation, does not mingle with the cleaning solution because all but a small residual of the cleaning agent solution exits the transparent cleaning agent mixing chamber during the flush operation such that the water level of the cleaning agent solution does not reach the bottom of the mixing chamber inlet port during a flush operation.

Figure 3:
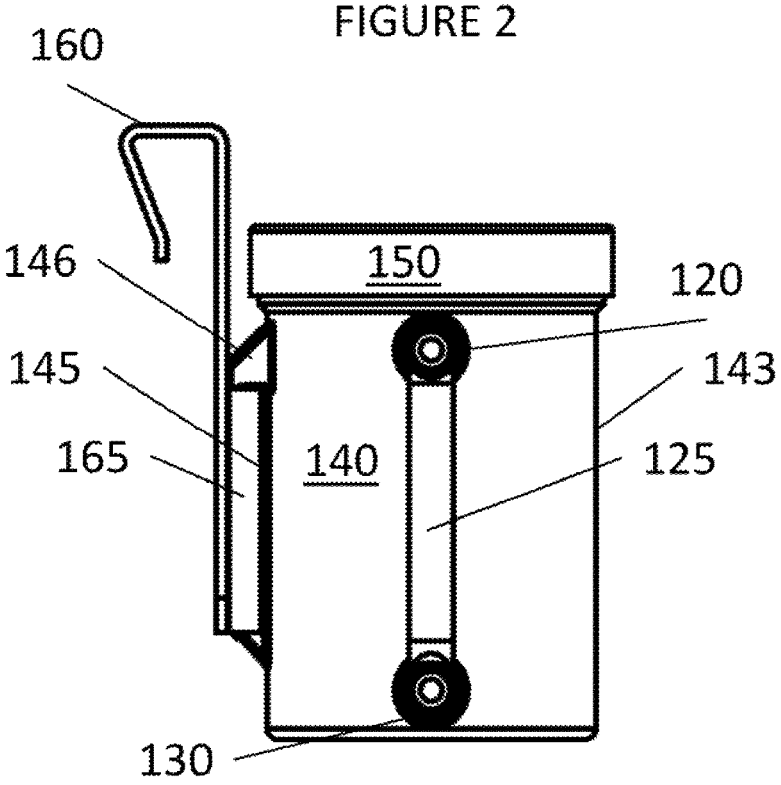
FIG. 3 illustrates a side view of the assembled cleaning agent dispensing system of FIG. 2.

FIG. 3 illustrates a side view of the assembled cleaning agent dispensing system of FIG. 2. As illustrated in FIG. 3, a cleaning agent dispensing system includes a transparent cleaning agent mixing chamber 140, having a front side 143 and a backside 145, for mixing water with a cleaning agent tablet. The cleaning agent dispensing system is configured to attach to a wall of a toilet water tank (not shown) via clip mechanism 160. The cleaning agent dispensing system also includes a lid 150 configured to cover and seal the transparent cleaning agent mixing chamber 140.

The cleaning agent dispensing system includes an inlet port 120 for receiving water from a fill valve (not shown) via a tube (not shown). The transparent cleaning agent mixing chamber 140 includes a mixing chamber inlet port (not shown) for enabling water received by the inlet port 120 to enter the transparent cleaning agent mixing chamber 140. Between the inlet port 120 and the mixing chamber inlet port, a trap 125 is located to prevent gases from the cleaning agent solution or the cleaning agent solution, itself, from travelling back towards the fill valve (not shown).

The cleaning agent dispensing system includes an outlet port 130 for outputting cleaning agent solution to an overflow tube (not shown) via a tube (not shown). The transparent cleaning agent mixing chamber 140 includes a mixing chamber outlet port (not shown) for enabling the cleaning agent solution in the transparent cleaning agent mixing chamber 140 to exit to the overflow tube (not shown).

Based upon the configuration of the mixing chamber inlet port and the mixing chamber outlet port, the trap remains filled with clean incoming water from the filler valve (not shown) after a flush operation, and the water remaining in trap 125, after the flush operation, does not mingle with the cleaning solution because all but a small residual of the cleaning agent solution exits the transparent cleaning agent mixing chamber during the flush operation such that the water level of the cleaning agent solution does not reach the bottom of the mixing chamber inlet port during a flush operation.

Lastly, the cleaning agent dispensing system includes a clip mechanism attachment interface 165, configured to attach to a cleaning agent mixing chamber attachment interface 146, the cleaning agent mixing chamber attachment interface 146 being located on the back side 145 of the transparent cleaning agent mixing chamber 140.

Figure 4:
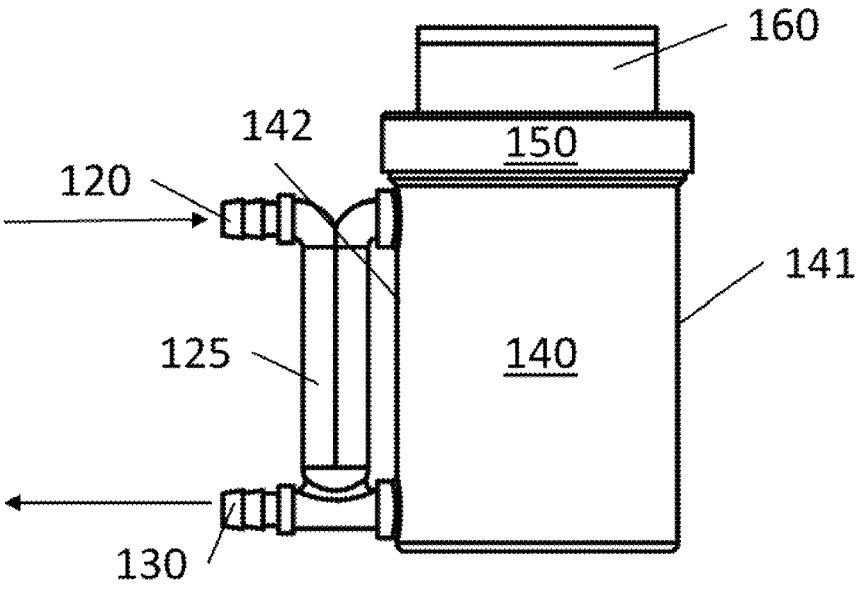
FIG. 4 illustrates a front view of the assembled cleaning agent dispensing system of FIG. 2.

FIG. 4 illustrates a front view of the assembled cleaning agent dispensing system of FIG. 2. As illustrated in FIG. 4, a cleaning agent dispensing system includes a transparent cleaning agent mixing chamber 140 for mixing water with a cleaning agent tablet. The cleaning agent dispensing system is configured to attach to a wall of a toilet water tank (not shown) via clip mechanism 160. The cleaning agent dispensing system also includes a lid 150 configured to cover and seal the transparent cleaning agent mixing chamber 140.

The cleaning agent dispensing system includes an inlet port 120 for receiving water (see arrow for water flow direction) from a fill valve (not shown) via a tube (not shown). The transparent cleaning agent mixing chamber 140 includes a mixing chamber inlet port (not shown) for enabling water received by the inlet port 120 to enter the transparent cleaning agent mixing chamber 140. Between the inlet port 120 and the mixing chamber inlet port, a trap 125 is located to prevent gases from the cleaning agent solution or the cleaning agent solution, itself, from travelling back towards the fill valve (not shown).

The cleaning agent dispensing system includes an outlet port 130 for outputting cleaning agent solution (see arrow for cleaning agent solution flow direction) to an overflow tube (not shown) via a tube (not shown). The transparent cleaning agent mixing chamber 140 includes a mixing chamber outlet port (not shown) for enabling the cleaning agent solution in the transparent cleaning agent mixing chamber 140 to exit to the overflow tube (not shown).

Based upon the configuration of the mixing chamber inlet port and the mixing chamber outlet port, the trap remains filled with clean incoming water from the filler valve (not shown) after a flush operation, and the water remaining in trap 125, after the flush operation, does not mingle with the cleaning solution because all but a small residual of the cleaning agent solution exits the transparent cleaning agent mixing chamber during the flush operation such that the water level of the cleaning agent solution does not reach the bottom of the mixing chamber inlet port during a flush operation.

The transparent cleaning agent mixing chamber 140 includes a first side 142, which engages the inlet port 120 and the outlet port 130, and a second side 141, opposite the first side 142.

Figure 5:
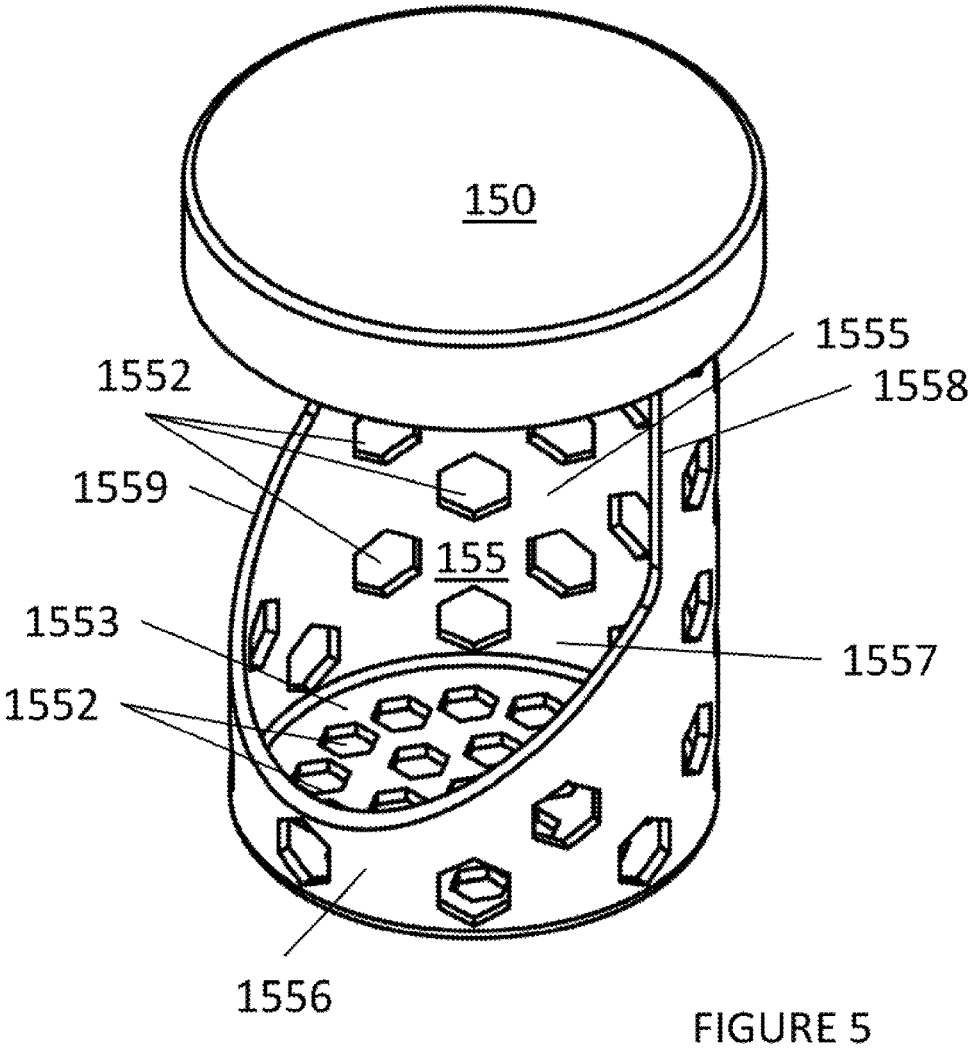
FIG. 5 illustrates a perspective view of an integrated lid/tablet cradle for use with the assembled cleaning agent dispensing system of FIG. 2.

FIG. 5 illustrates a perspective view of an integrated lid/tablet cradle for use with the assembled cleaning agent dispensing system of FIG. 2. As illustrated in FIG. 5, an integrated lid/tablet cradle includes a lid 150 and a tablet cradle 155. The tablet cradle 155 includes a cradle back side 1555 having multiple apertures 1552 to allow water/solution to flow therethrough.

The tablet cradle 155 has a first cradle side 1559, corresponding to the first side (142 of FIG. 4) of the transparent cleaning agent mixing chamber (140 of FIG. 4), and a second cradle side 1558, corresponding to the second side (141 of FIG. 4) of the transparent cleaning agent mixing chamber (140 of FIG. 4). The tablet cradle 155 has a cradle front side 1556 and a floor 1533. The first cradle side 1559, the second cradle side 1558, the cradle front side 1556, and the floor 1533 have multiple apertures 1552 to allow water/solution to flow therethrough.

The lid 150 and tablet cradle 155 are integrally formed and configured such that when the lid 150 is properly engaged with the transparent cleaning agent mixing chamber (140 of FIG. 3), the cradle front side 1556 corresponds to the front side (143 of FIG. 3) of the transparent cleaning agent mixing chamber (140 of FIG. 3).

The tablet cradle 155 includes an opening 1557, wherein a portion of the first cradle side 1559, the second cradle side 1558, and the cradle front side 1556 are missing to allow a substantially unobstructed view of a cleaning agent tablet in the tablet cradle, while the tablet cradle 155 is located within the transparent cleaning agent mixing chamber. Moreover, opening 1557 is configured to enable easy access, through opening 1557, to a cleaning agent tablet in the tablet cradle.

Figure 6:
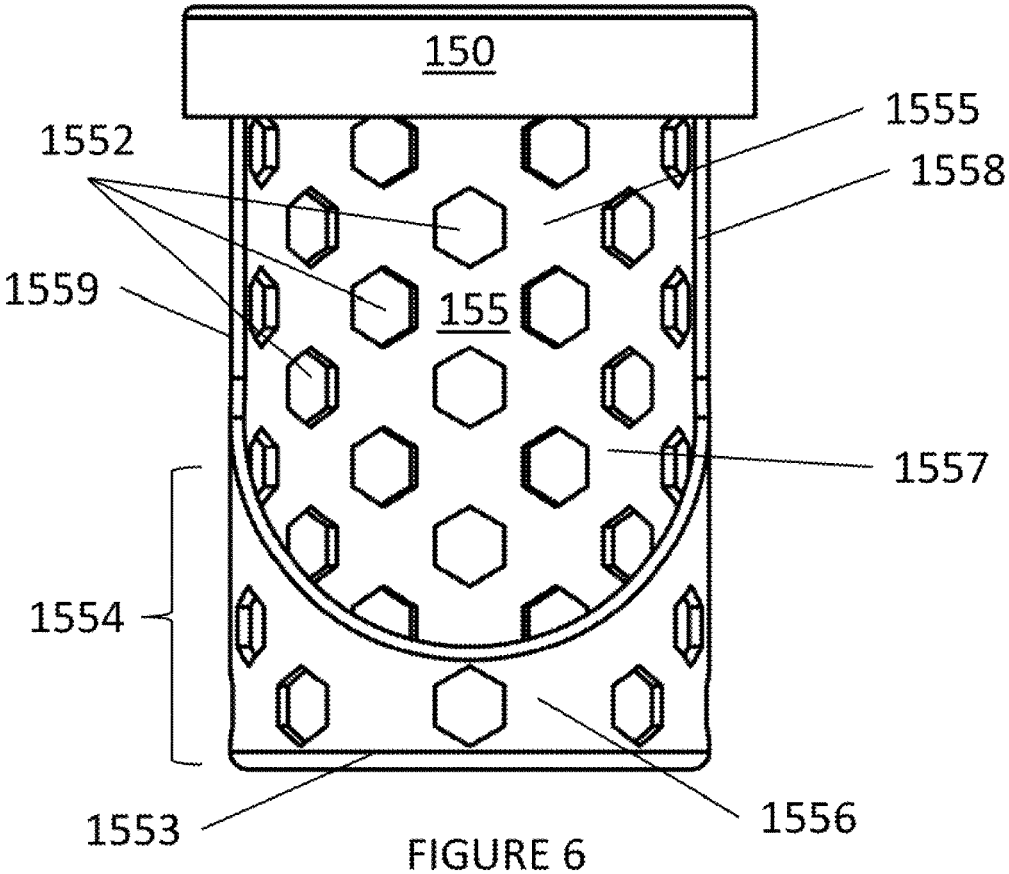
FIG. 6 illustrates a front view of the integrated lid/tablet cradle of FIG. 5.

FIG. 6 illustrates a front view of the integrated lid/tablet cradle of FIG. 5. As illustrated in FIG. 6, an integrated lid/tablet cradle includes a lid 150 and a tablet cradle 155. The tablet cradle 155 includes a cradle portion 1554 for holding a cleaning agent tablet (not shown). The tablet cradle 155 also includes a cradle back side 1555 having multiple apertures 1552 to allow water/solution to flow therethrough. The tablet cradle 155 has a first cradle side 1559, corresponding to the first side (142 of FIG. 4) of the transparent cleaning agent mixing chamber (140 of FIG. 4), and a second cradle side 1558, corresponding to the second side (141 of FIG. 4) of the transparent cleaning agent mixing chamber (140 of FIG. 4).

The tablet cradle 155 has a cradle front side 1556 and a floor 1533. The first cradle side 1559, the second cradle side 1558, the cradle front side 1556, and the floor 1533 have multiple apertures 1552 to allow water/solution to flow therethrough.

The lid 150 and tablet cradle 155 are integrally formed and configured such that when the lid 150 is properly engaged with the transparent cleaning agent mixing chamber (140 of FIG. 3), the cradle front side 1556 corresponds to the front side (143 of FIG. 3) of the transparent cleaning agent mixing chamber (140 of FIG. 3).

The tablet cradle 155 includes an opening 1557, wherein a portion of the first cradle side 1559, the second cradle side 1558, and the cradle front side 1556 are missing to allow a substantially unobstructed view of a cleaning agent tablet in the tablet cradle, while the tablet cradle 155 is located within the transparent cleaning agent mixing chamber. A portion of opening 1557 is in the cradle portion 1554. Moreover, opening 1557 is configured to enable easy access, through opening 1557, to a cleaning agent tablet in the tablet cradle.

Figure 7:
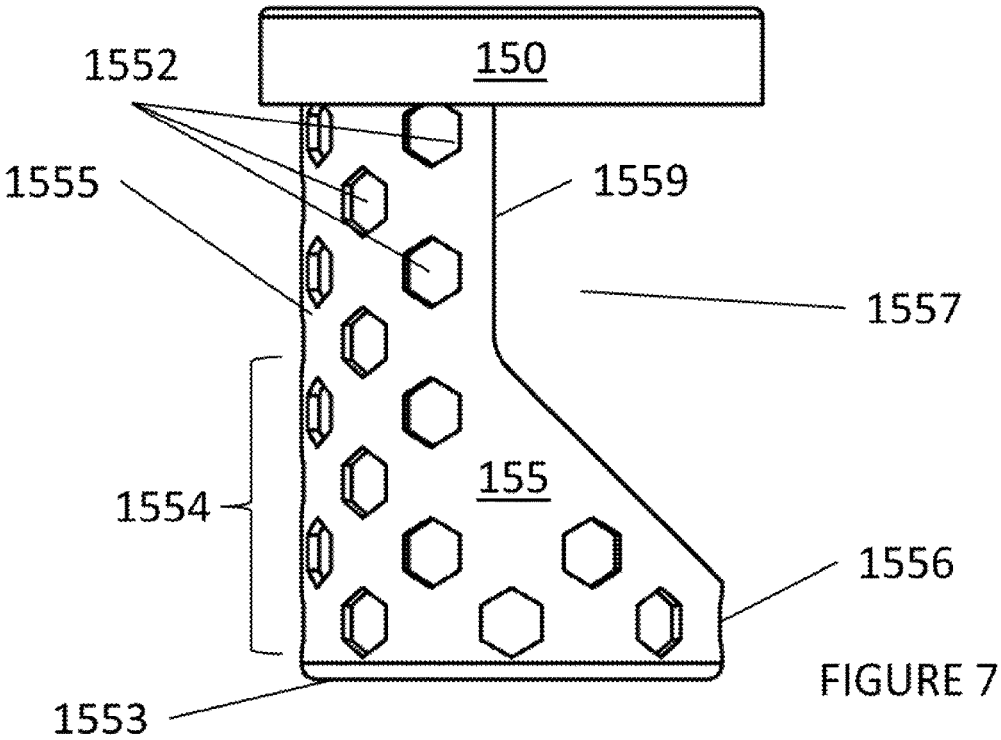
FIG. 7 illustrates a side view of the integrated lid/tablet cradle of FIG. 5.

FIG. 7 illustrates a side view of the integrated lid/tablet cradle of FIG. 5. As illustrated in FIG. 7, an integrated lid/tablet cradle includes a lid 150 and a tablet cradle 155. The tablet cradle 155 includes a cradle portion 1554 for holding a cleaning agent tablet (not shown). The tablet cradle 155 also includes a cradle back side 1555 having multiple apertures 1552 to allow water/solution to flow therethrough. The tablet cradle 155 has a first cradle side 1559, corresponding to the first side (142 of FIG. 4) of the transparent cleaning agent mixing chamber (140 of FIG. 4), and a second cradle side (not shown), corresponding to the second side (141 of FIG. 4) of the transparent cleaning agent mixing chamber (140 of FIG. 4). The tablet cradle 155 has a cradle front side 1556 and a floor 1533. The first cradle side 1559, the second cradle side (not shown), the cradle front side 1556, and the floor 1533 have multiple apertures 1552 to allow water/solution to flow therethrough.

The lid 150 and tablet cradle 155 are integrally formed and configured such that when the lid 150 is properly engaged with the transparent cleaning agent mixing chamber (140 of FIG. 3), the cradle front side 1556 corresponds to the front side (143 of FIG. 3) of the transparent cleaning agent mixing chamber (140 of FIG. 3).

The tablet cradle 155 includes an opening 1557, wherein a portion of the first cradle side 1559, the second cradle side (not shown), and the cradle front side 1556 are missing to allow a substantially unobstructed view of a cleaning agent tablet in the tablet cradle, while the tablet cradle 155 is located within the transparent cleaning agent mixing chamber.

A portion of opening 1557 is in the cradle portion 1554. Moreover, opening 1557 is configured to enable easy access, through opening 1557, to a cleaning agent tablet in the tablet cradle.

Figure 8:
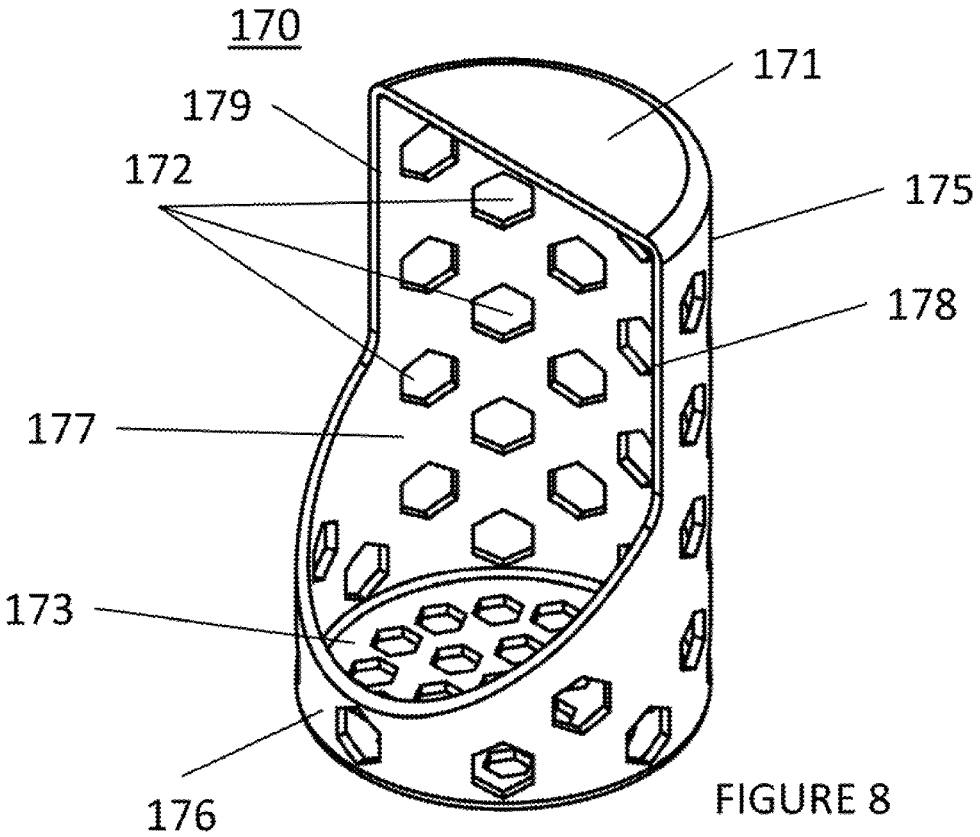
FIG. 8 illustrates a perspective view of a tablet cradle for use with the assembled cleaning agent dispensing system of FIG. 2.

FIG. 8 illustrates a perspective view of a tablet cradle for use with the assembled cleaning agent dispensing system of FIG. 2. As illustrated in FIG. 8, a tablet cradle 170 includes a cradle back side 175 having multiple apertures 172 to allow water/solution to flow therethrough. The tablet cradle 170 has a first cradle side 179, corresponding to the first side (142 of FIG. 4) of the transparent cleaning agent mixing chamber (140 of FIG. 4), and a second cradle side 178, corresponding to the second side (141 of FIG. 4) of the transparent cleaning agent mixing chamber (140 of FIG. 4).

The tablet cradle 170 has a cradle front side 176 and a floor 173. The first cradle side 179, the second cradle side 178, the cradle front side 176, and the floor 173 have multiple apertures 172 to allow water/solution to flow therethrough.

The tablet cradle 170 includes an opening 177, wherein a portion of the first cradle side 179, the second cradle side 178, and the cradle front side 176 are missing to allow a substantially unobstructed view of a cleaning agent tablet in the tablet cradle, while the tablet cradle 170 is located within the transparent cleaning agent mixing chamber. A portion of opening 177 is in the cradle portion. Moreover, opening 177 is configured to enable easy access, through opening 177, to a cleaning agent tablet in the tablet cradle.

Figure 9:
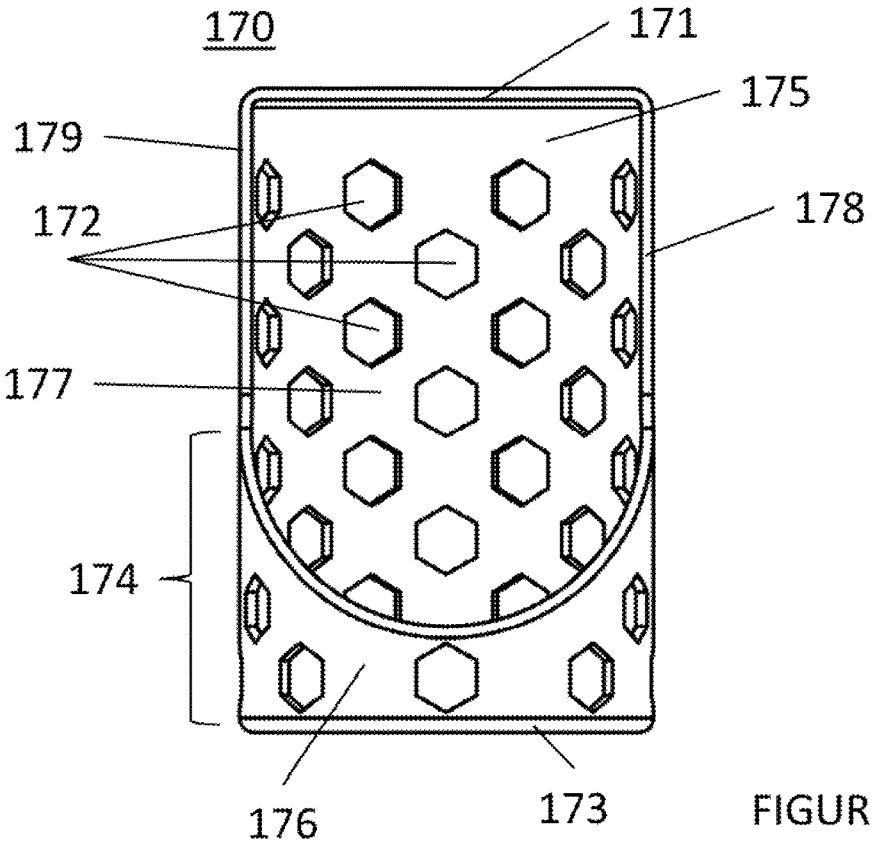
FIG. 9 illustrates a front view of the tablet cradle of FIG. 8.

FIG. 9 illustrates a front view of the tablet cradle of FIG. 8. As illustrated in FIG. 9, a tablet cradle 170 includes a cradle back side 175 having multiple apertures 172 to allow water/solution to flow therethrough. The tablet cradle 170 has a first cradle side 179, corresponding to the first side (142 of FIG. 4) of the transparent cleaning agent mixing chamber (140 of FIG. 4), and a second cradle side 178, corresponding to the second side (141 of FIG. 4) of the transparent cleaning agent mixing chamber (140 of FIG. 4). The tablet cradle 170 has a cradle front side 176 and a floor 173. The first cradle side 179, the second cradle side 178, the cradle front side 176, and the floor 173 have multiple apertures 172 to allow water/solution to flow therethrough.

The tablet cradle 170 includes an opening 177, wherein a portion of the first cradle side 179, the second cradle side 178, and the cradle front side 176 are missing to allow a substantially unobstructed view of a cleaning agent tablet in the tablet cradle, while the tablet cradle 170 is located within the transparent cleaning agent mixing chamber. A portion of opening 177 is in the cradle portion 174. Moreover, opening 177 is configured to enable easy access, through opening 177, to a cleaning agent tablet in the tablet cradle.

Figure 10:
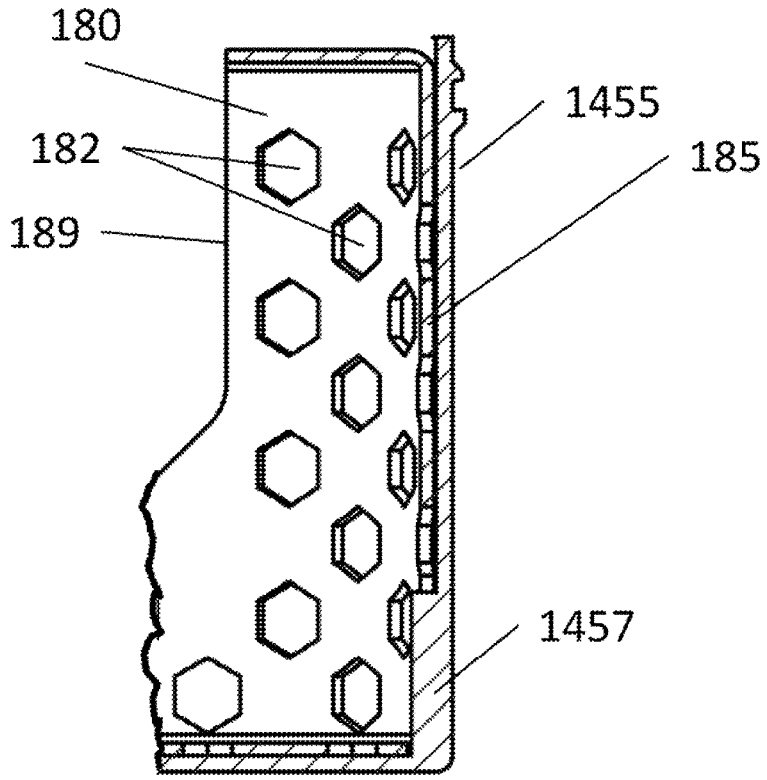
FIG. 10 illustrates a side view of a tablet cradle housed in a cleaning agent mixing chamber.

FIG. 10 illustrates a side view of a tablet cradle housed in a cleaning agent mixing chamber. As illustrated in FIG. 10, a tablet cradle 180 includes a first cradle side 189, corresponding to the first side (142 of FIG. 4) of the transparent cleaning agent mixing chamber (140 of FIG. 4), having multiple apertures 182 to allow water/solution to flow therethrough. The tablet cradle 180 also includes a cradle back side 185, which engages a back side 1455 of a transparent cleaning agent mixing chamber. The back side 1455 of the transparent cleaning agent mixing chamber includes a notch 1457, configured to interface with a groove or channel (not shown) on the cradle back side 185, such that the groove or channel (not shown) on the cradle back side 185 and the notch 1457 causes the tablet cradle 180 to be orientated such that a front side of the tablet cradle 180 corresponds to a front side of the transparent cleaning agent mixing chamber, thereby providing a substantially unobstructed view to the cleaning agent tablet in the tablet cradle 180.

Figure 11:
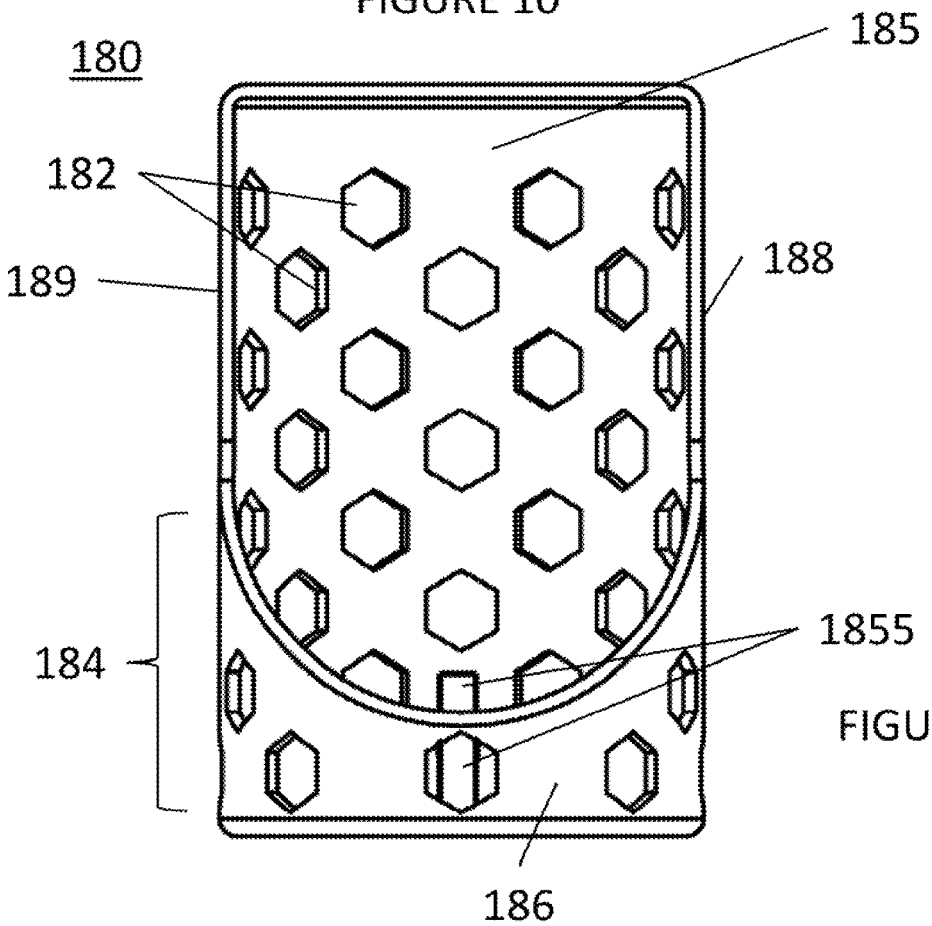
FIG. 11 illustrates a front view of the tablet cradle of FIG. 10.

FIG. 11 illustrates a front view of the tablet cradle of FIG. 10. As illustrated in FIG. 11, a tablet cradle 180 includes a cradle back side 185 having multiple apertures 182 to allow water/solution to flow therethrough. The tablet cradle 180 has a first cradle side 189, corresponding to the first side (142 of FIG. 4) of the transparent cleaning agent mixing chamber (140 of FIG. 4), and a second cradle side 188, corresponding to the second side (141 of FIG. 4) of the transparent cleaning agent mixing chamber (140 of FIG. 4). The tablet cradle 180 has a cradle front side 186 and a floor. The first cradle side 189, the second cradle side 188, the cradle front side 186, and the floor have multiple apertures to allow water/solution to flow therethrough.

The tablet cradle 180 includes a cradle portion 184. The cradle back side 185 includes a groove or channel 1855, configured to interface with a notch (notch 1457 of FIG. 10) on the back side of a transparent cleaning agent mixing chamber, such that the groove or channel 1855 and the notch (not shown) causes the tablet cradle 180 to be orientated such that a front side of the tablet cradle 180 corresponds to a front side of the transparent cleaning agent mixing chamber, thereby providing a substantially unobstructed view to the cleaning agent tablet in the tablet cradle 180.

The groove or channel 1855 may be located within the cradle portion 184 of cradle back side 185.

Figure 12:
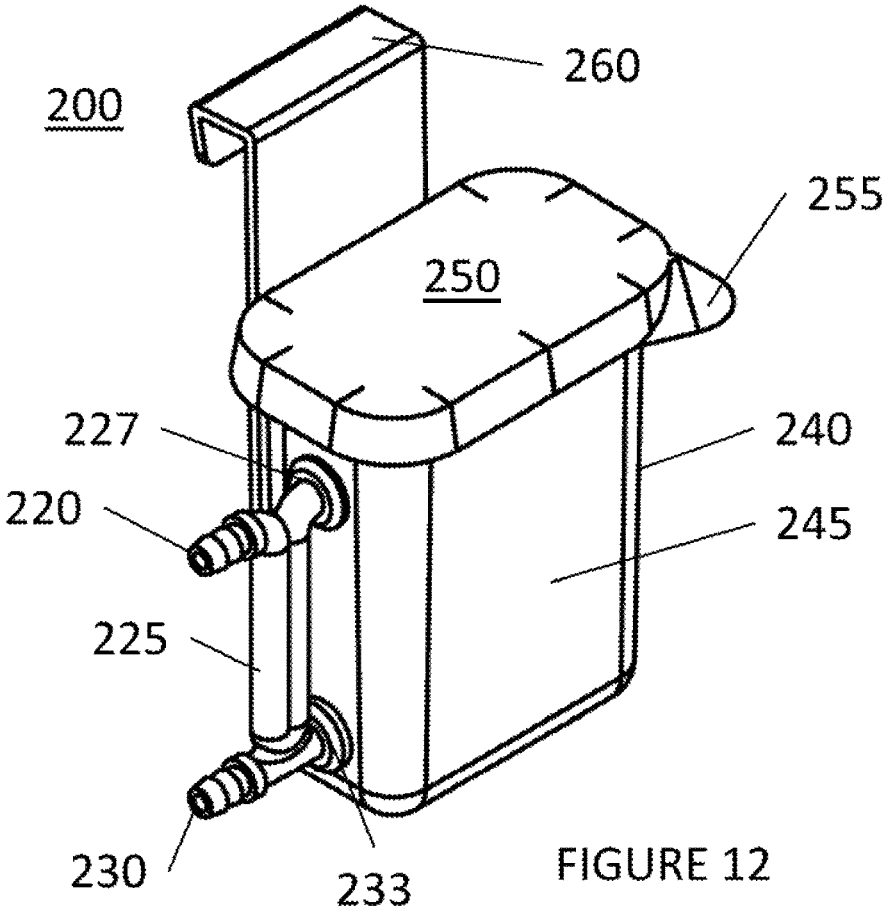
FIG. 12 illustrates a perspective view of another embodiment of an assembled cleaning agent dispensing system.

FIG. 12 illustrates a perspective view of another embodiment of an assembled cleaning agent dispensing system. As illustrated in FIG. 12, a cleaning agent dispensing system 200 includes a cleaning agent mixing chamber 240 for mixing water with a cleaning agent tablet. The cleaning agent dispensing system 200 is configured to attach to a wall of a toilet water tank (not shown) via clip mechanism 260. The cleaning agent dispensing system 200 also includes a lid 250 configured to cover and seal the cleaning agent mixing chamber 240. The lid 250 includes tab 255 to facilitate removal of the lid 250 from the cleaning agent mixing chamber 240.

The cleaning agent dispensing system 200 includes an inlet port 220 for receiving water from a fill valve (not shown) via a tube (not shown). The cleaning agent mixing chamber 240 includes a mixing chamber inlet port 227 for enabling water received by the inlet port 220 to enter the cleaning agent mixing chamber 240. Between the inlet port 220 and the mixing chamber inlet port 127, a trap 225 is located to prevent gases from the cleaning agent solution or the cleaning agent solution, itself, from travelling back towards the fill valve (not shown).

The cleaning agent dispensing system 200 includes an outlet port 230 for outputting cleaning agent solution to an overflow tube (not shown) via a tube (not shown). The cleaning agent mixing chamber 240 includes a mixing chamber outlet port 233 for enabling the cleaning agent solution in the cleaning agent mixing chamber 240 to exit to the overflow tube (not shown).

Lastly, the cleaning agent mixing chamber 240 includes a transparent window or wall 245 to enable a user to visibly observe a cleaning agent tablet within the cleaning agent mixing chamber 240.

Based upon the configuration of the mixing chamber inlet port and the mixing chamber outlet port, the trap remains filled with clean incoming water from the filler valve (not shown) after a flush operation, and the water remaining in trap 225, after the flush operation, does not mingle with the cleaning solution because all but a small residual of the cleaning agent solution exits the transparent cleaning agent mixing chamber during the flush operation such that the water level of the cleaning agent solution does not reach the bottom of the mixing chamber inlet port during a flush operation.

Figure 13:
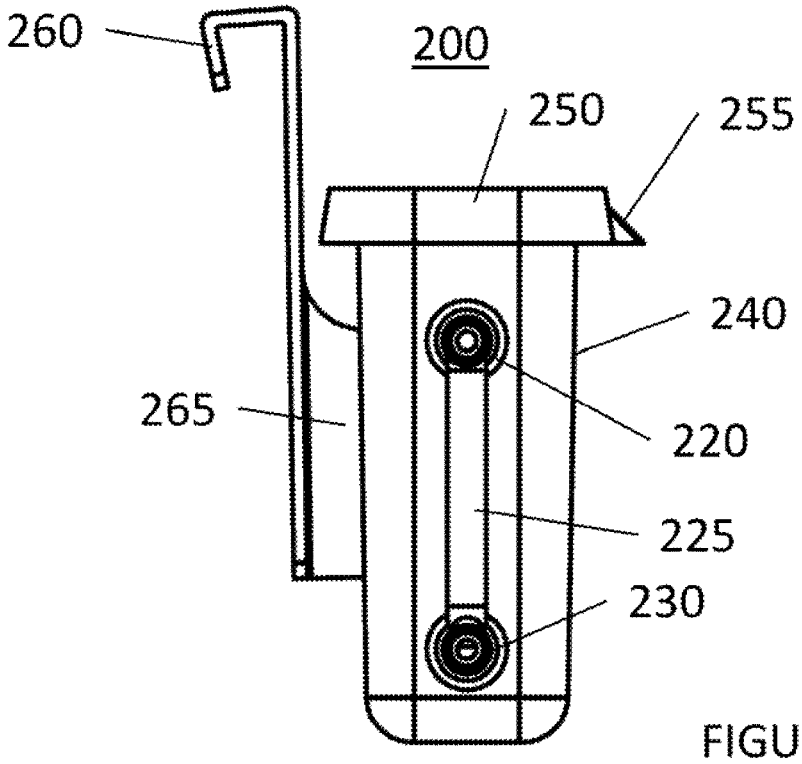
FIG. 13 illustrates a side view of the assembled cleaning agent dispensing system of FIG. 12.

FIG. 13 illustrates a side view of the assembled cleaning agent dispensing system of FIG. 12. As illustrated in FIG. 13, a cleaning agent dispensing system includes a cleaning agent mixing chamber 240 for mixing water with a cleaning agent tablet. The cleaning agent dispensing system is configured to attach to a wall of a toilet water tank (not shown) via clip mechanism 260.

The cleaning agent dispensing system also includes a lid 250 configured to cover and seal the transparent cleaning agent mixing chamber 240. The lid 250 includes tab 255 to facilitate removal of the lid 250 from the cleaning agent mixing chamber 240.

The cleaning agent dispensing system includes an inlet port 220 for receiving water from a fill valve (not shown) via a tube (not shown). The cleaning agent mixing chamber 240 includes a mixing chamber inlet port (not shown) for enabling water received by the inlet port 220 to enter the cleaning agent mixing chamber 240. Between the inlet port 220 and the mixing chamber inlet port, a trap 225 is located to prevent gases from the cleaning agent solution or the cleaning agent solution, itself, from travelling back towards the fill valve (not shown).

The cleaning agent dispensing system includes an outlet port 230 for outputting cleaning agent solution to an overflow tube (not shown) via a tube (not shown). The cleaning agent mixing chamber 240 includes a mixing chamber outlet port (not shown) for enabling the cleaning agent solution in the cleaning agent mixing chamber 240 to exit to the overflow tube (not shown).

Based upon the configuration of the mixing chamber inlet port and the mixing chamber outlet port, the trap remains filled with clean incoming water from the filler valve (not shown) after a flush operation, and the water remaining in trap 225, after the flush operation, does not mingle with the cleaning solution because all but a small residual of the cleaning agent solution exits the cleaning agent mixing chamber during the flush operation such that the water level of the cleaning agent solution does not reach the bottom of the mixing chamber inlet port during a flush operation.

Lastly, the cleaning agent dispensing system includes a clip mechanism attachment interface 265, configured to attach to a cleaning agent mixing chamber attachment interface (not shown), the cleaning agent mixing chamber attachment interface (not shown) being located on a back side of the cleaning agent mixing chamber 240.

Figure 14:
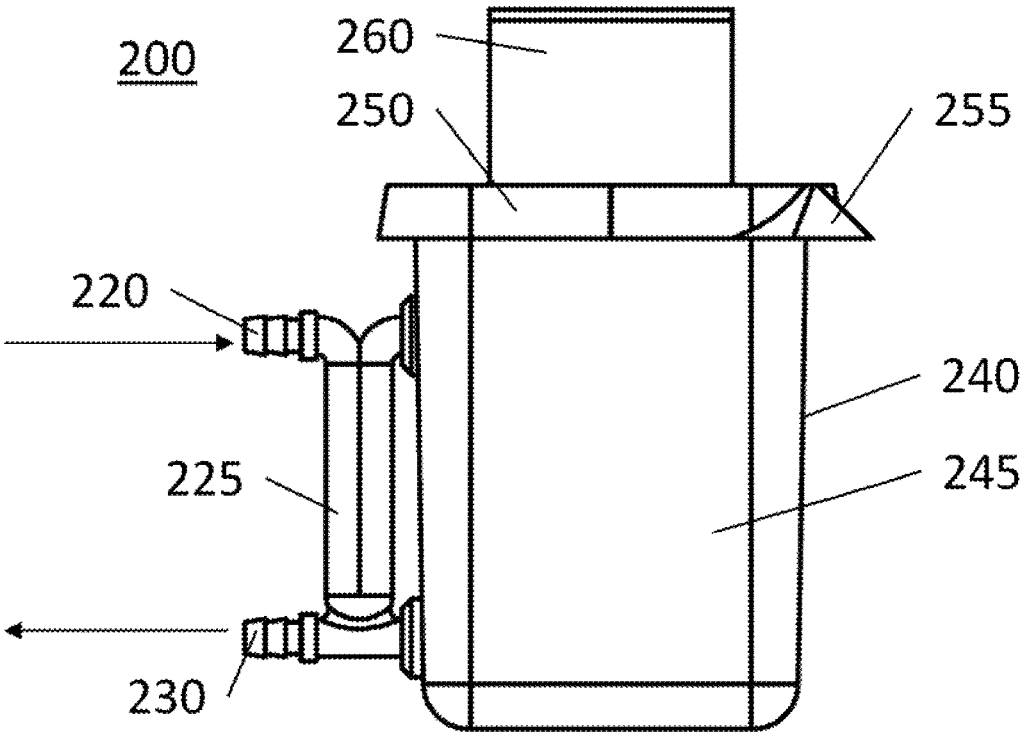
FIG. 14 illustrates a front view of the assembled cleaning agent dispensing system of FIG. 12.

FIG. 14 illustrates a front view of the assembled cleaning agent dispensing system of FIG. 12. As illustrated in FIG. 14, a cleaning agent dispensing system includes a cleaning agent mixing chamber 240 for mixing water with a cleaning agent tablet. The cleaning agent dispensing system is configured to attach to a wall of a toilet water tank (not shown) via clip mechanism 260. The cleaning agent dispensing system also includes a lid 250 configured to cover and seal the cleaning agent mixing chamber 240.

The cleaning agent dispensing system includes an inlet port 220 for receiving water (see arrow for water flow direction) from a fill valve (not shown) via a tube (not shown). The cleaning agent mixing chamber 240 includes a mixing chamber inlet port (not shown) for enabling water received by the inlet port 220 to enter the cleaning agent mixing chamber 240. Between the inlet port 220 and the mixing chamber inlet port, a trap 225 is located to prevent gases from the cleaning agent solution or the cleaning agent solution, itself, from travelling back towards the fill valve (not shown).

The cleaning agent dispensing system includes an outlet port 230 for outputting cleaning agent solution (see arrow for cleaning agent solution flow direction) to an overflow tube (not shown) via a tube (not shown). The cleaning agent mixing chamber 240 includes a mixing chamber outlet port (not shown) for enabling the cleaning agent solution in the cleaning agent mixing chamber 240 to exit to the overflow tube (not shown).

Based upon the configuration of the mixing chamber inlet port and the mixing chamber outlet port, the trap remains filled with clean incoming water from the filler valve (not shown) after a flush operation, and the water remaining in trap 225, after the flush operation, does not mingle with the cleaning solution because all but a small residual of the cleaning agent solution exits the transparent cleaning agent mixing chamber during the flush operation such that the water level of the cleaning agent solution does not reach the bottom of the mixing chamber inlet port during a flush operation.

Figure 15:
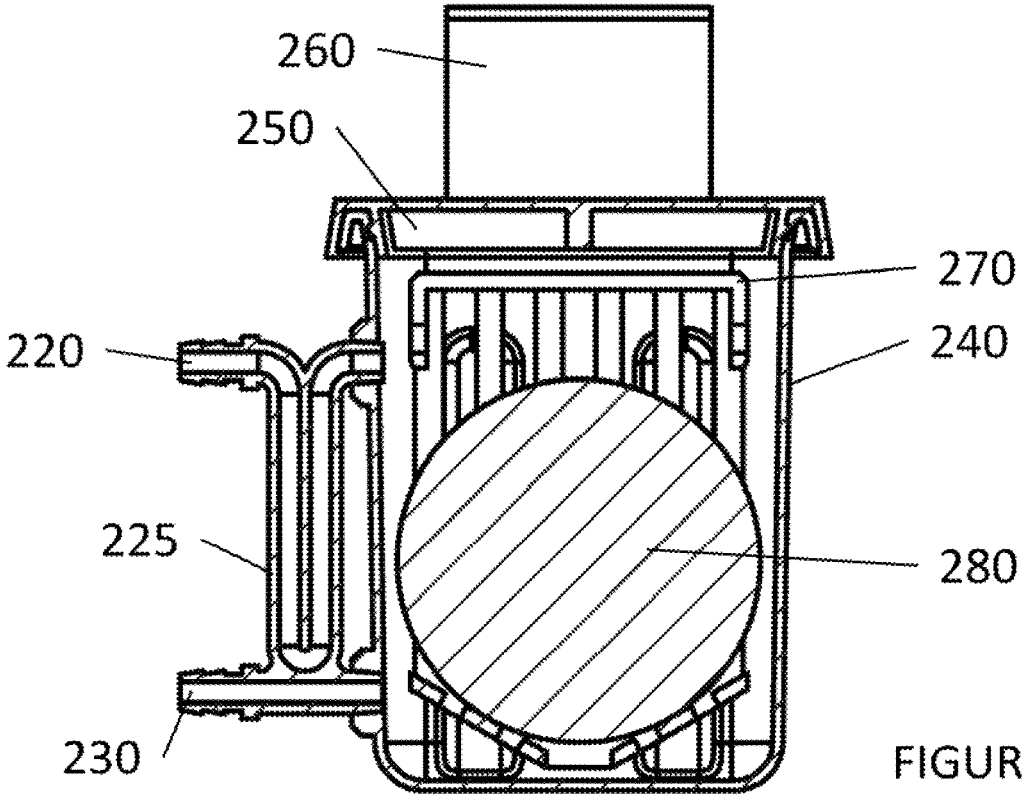
FIG. 15 illustrates a cut-away view of the assembled cleaning agent dispensing system of FIG. 12.

FIG. 15 illustrates a cut-away view of the assembled cleaning agent dispensing system of FIG. 12. As illustrated in FIG. 15, a cleaning agent dispensing system includes a cleaning agent mixing chamber 240 for mixing water with a cleaning agent tablet 280. The cleaning agent tablet 280 is secured in the cleaning agent mixing chamber 240 by tablet cradle 270. The cleaning agent dispensing system is configured to attach to a wall of a toilet water tank (not shown) via clip mechanism 260. The cleaning agent dispensing system also includes a lid 250 configured to cover and seal the cleaning agent mixing chamber 240.

The cleaning agent dispensing system includes an inlet port 220 for receiving water from a fill valve (not shown) via a tube (not shown). The cleaning agent mixing chamber 240 includes a mixing chamber inlet port (not shown) for enabling water received by the inlet port 220 to enter the cleaning agent mixing chamber 240. Between the inlet port 220 and the mixing chamber inlet port, a trap 225 is located to prevent gases from the cleaning agent solution or the cleaning agent solution, itself, from travelling back towards the fill valve (not shown).

The cleaning agent dispensing system includes an outlet port 230 for outputting cleaning agent solution to an overflow tube (not shown) via a tube (not shown). The cleaning agent mixing chamber 240 includes a mixing chamber outlet port (not shown) for enabling the cleaning agent solution in the cleaning agent mixing chamber 240 to exit to the overflow tube (not shown).

Based upon the configuration of the mixing chamber inlet port and the mixing chamber outlet port, the trap remains filled with clean incoming water from the filler valve (not shown) after a flush operation, and the water remaining in trap 225, after the flush operation, does not mingle with the cleaning solution because all but a small residual of the cleaning agent solution exits the transparent cleaning agent mixing chamber during the flush operation such that the water level of the cleaning agent solution does not reach the bottom of the mixing chamber inlet port during a flush operation.

Figure 16:
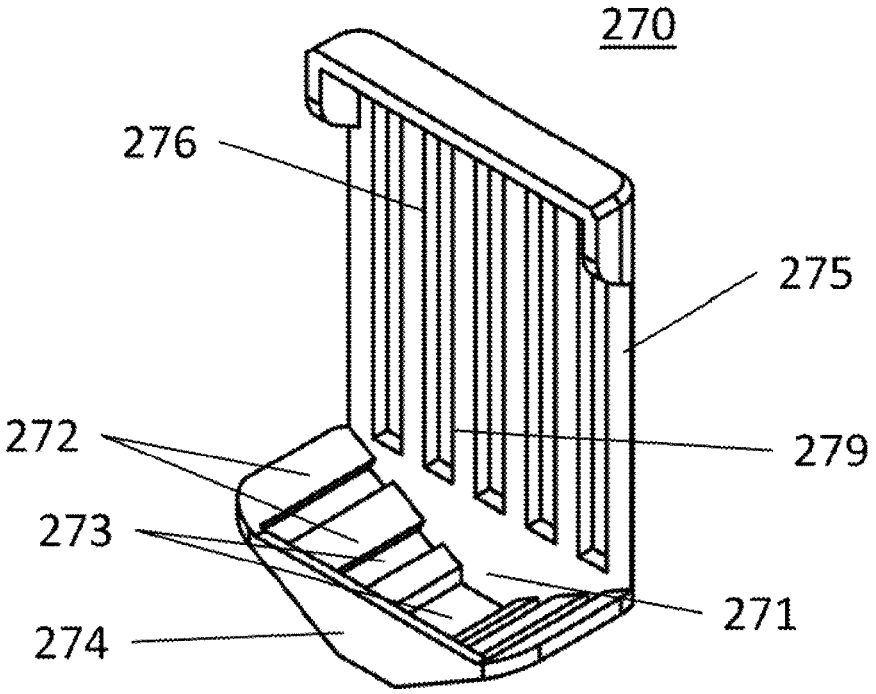
FIG. 16 illustrates a tablet cradle for use with the assembled cleaning agent dispensing system of FIG. 12.

FIG. 16 illustrates a tablet cradle for use with the assembled cleaning agent dispensing system of FIG. 12. As illustrated in FIG. 16, a tablet cradle 270 includes a back plate member 275 having multiple apertures 276 to allow water to flow therethrough. The tablet cradle 270 also includes a front plate member 274 and lateral members 372. The lateral members 372 are located between the back plate member 275 and the front plate member 274 to form a cavity 271 for holding a cleaning agent tablet. The lateral members 372 are also configured to form openings 273 in a bottom of the cavity 271 to allow water to flow therethrough.

The tablet cradle 270 includes an open volume 279, which is configured to allow a substantially unobstructed view of a cleaning agent tablet (not shown) within the tablet cradle 270.

Figure 17:
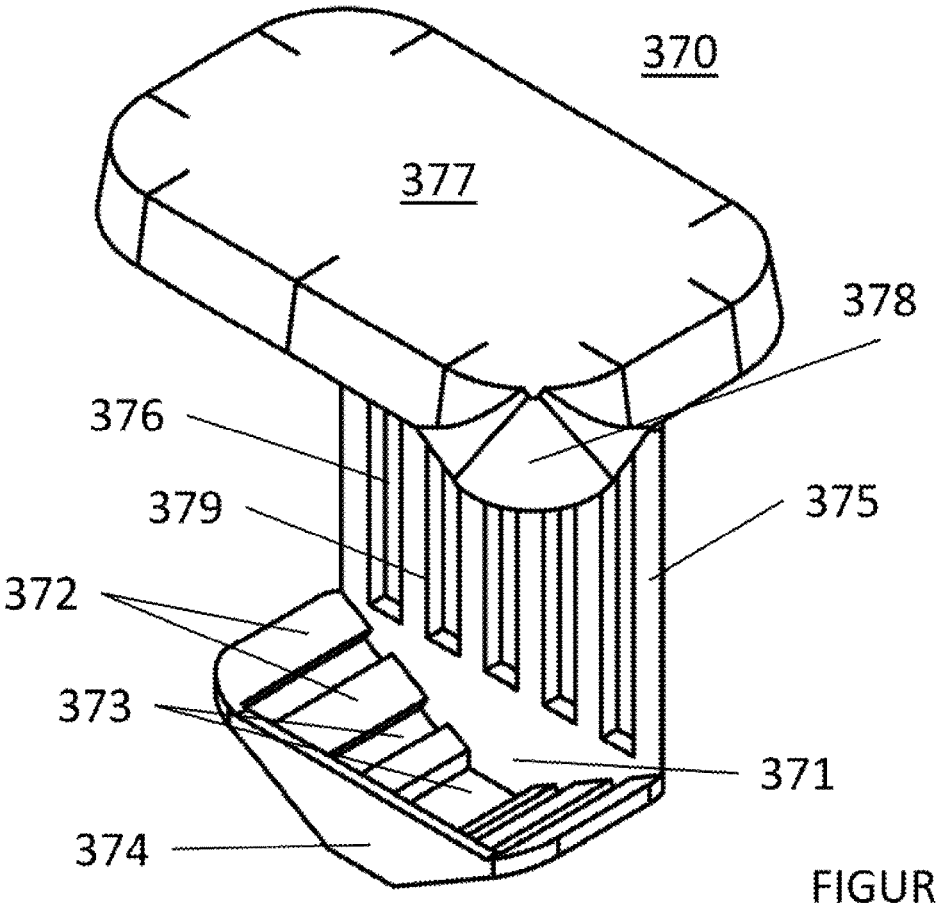
FIG. 17 illustrates an integrated lid/tablet cradle for use with the assembled cleaning agent dispensing system of FIG. 12.

FIG. 17 illustrates an integrated lid/tablet cradle for use with the assembled cleaning agent dispensing system of FIG. 12. As illustrated in FIG. 16, an integrated lid/tablet cradle 370 includes a back plate member 375 having multiple apertures 376 to allow water to flow therethrough. The tablet cradle 370 also includes a front plate member 374 and lateral members 372. The lateral members 372 are located between the back plate member 375 and the front plate member 274 to form a cavity 371 for holding a cleaning agent tablet. The lateral members 372 are also configured to form openings 373 in a bottom of the cavity 371 to allow water to flow therethrough.

The integrated lid/tablet cradle 370 also includes an integrated lid 377, having a tab 378 to facilitate removal of the lid 377 from a cleaning agent mixing chamber (not shown). The integrated lid 377 in integrated to a top portion of the back plate member 375.

The tablet cradle 370 includes an open volume 379, which is configured to allow a substantially unobstructed view of a cleaning agent tablet (not shown) within the tablet cradle 370.

Figure 18:
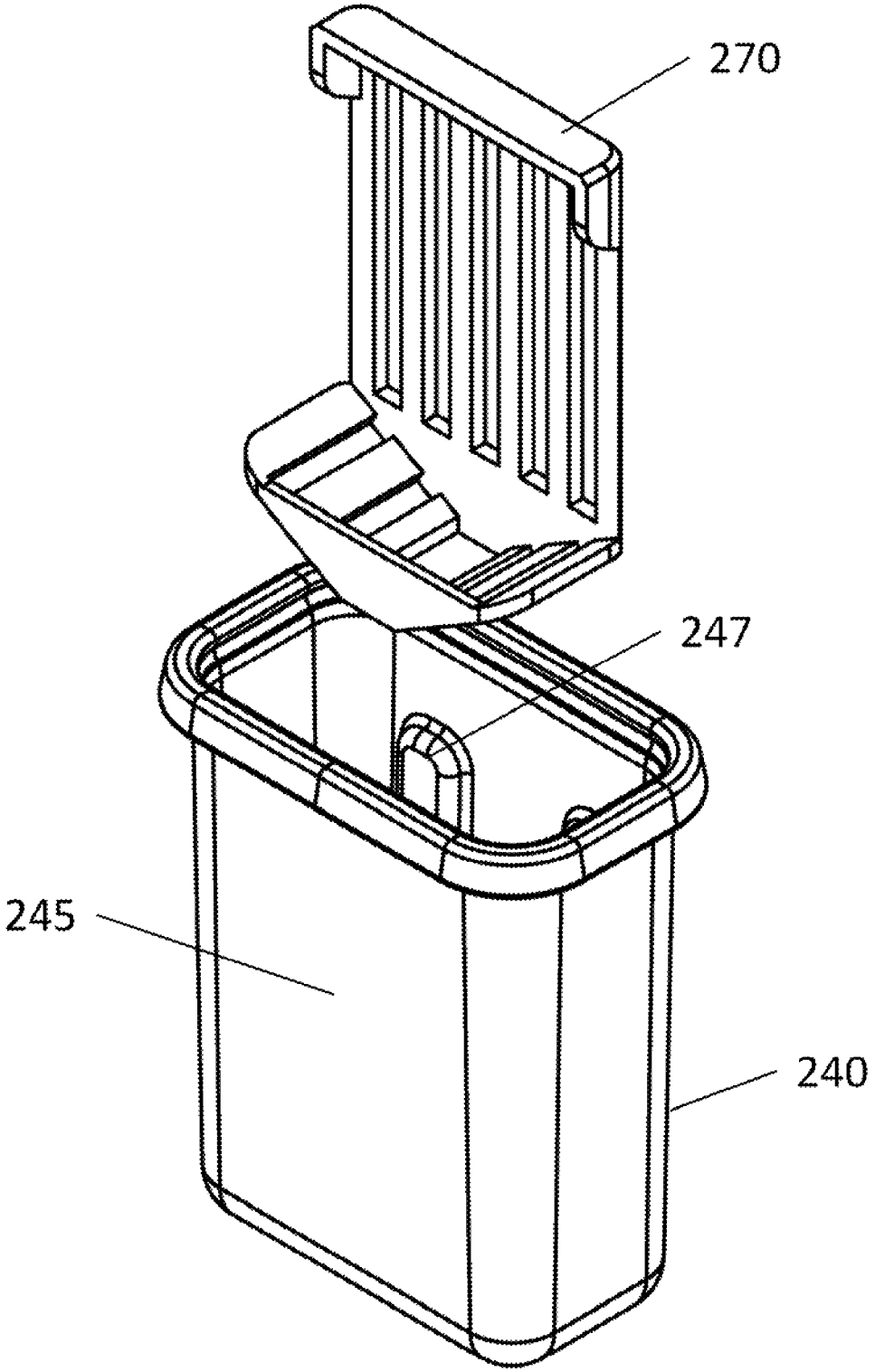
FIG. 18 illustrates another view of a cleaning agent dispensing system.

FIG. 18 illustrates another view of a cleaning agent dispensing system. As illustrated in FIG. 18, a cleaning agent dispensing system includes a tablet cradle 270 and a cleaning agent mixing chamber 240. The cleaning agent mixing chamber 240 has, on a front side thereof, a transparent window or wall 245. On a back side of the cleaning agent mixing chamber 240, channels or grooves 247 are formed to interface with a clip mechanism attachment interface (clip mechanism attachment interface 265 of FIG. 13).

Figure 19:
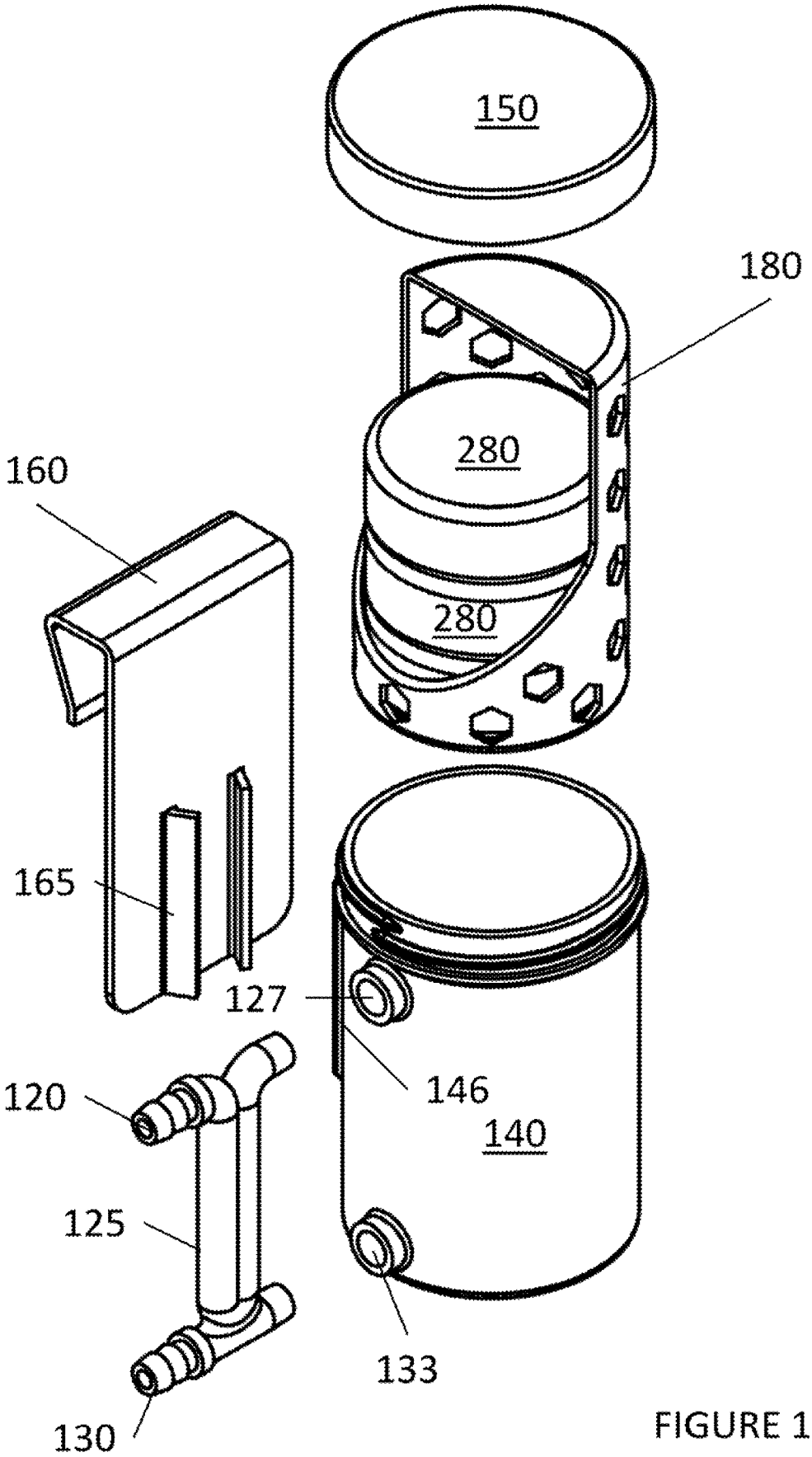
FIG. 19 illustrates another view of a cleaning agent dispensing system.

FIG. 19 illustrates another view of a cleaning agent dispensing system. As illustrated in FIG. 19, a cleaning agent dispensing system includes a transparent cleaning agent mixing chamber 140 for mixing water with cleaning agent tablets 280. The cleaning agent dispensing system is configured to attach to a wall of a toilet water tank (not shown) via clip mechanism 160. The cleaning agent dispensing system also includes a lid 150 configured to cover and seal the transparent cleaning agent mixing chamber 140.

The cleaning agent dispensing system includes an inlet port 120 for receiving water from a fill valve (not shown) via a tube (not shown). The transparent cleaning agent mixing chamber 140 includes a mixing chamber inlet port 127 for enabling water received by the inlet port 120 to enter the transparent cleaning agent mixing chamber 140. Between the inlet port 120 and the mixing chamber inlet port 127, a trap 125 is located to prevent gases from the cleaning agent solution or the cleaning agent solution, itself, from travelling back towards the fill valve (not shown).

The cleaning agent dispensing system includes an outlet port 130 for outputting cleaning agent solution to an overflow tube (not shown) via a tube (not shown). The transparent cleaning agent mixing chamber 140 includes a mixing chamber outlet port 133 for enabling the cleaning agent solution in the transparent cleaning agent mixing chamber 140 to exit to the overflow tube (not shown).

Based upon the configuration of the mixing chamber inlet port and the mixing chamber outlet port, the trap remains filled with clean incoming water from the filler valve (not shown) after a flush operation, and the water remaining in trap 125, after the flush operation, does not mingle with the cleaning solution because all but a small residual of the cleaning agent solution exits the transparent cleaning agent mixing chamber during the flush operation such that the water level of the cleaning agent solution does not reach the bottom of the mixing chamber inlet port during a flush operation.

Lastly, the cleaning agent dispensing system includes a clip mechanism attachment interface 165, configured to attach to a cleaning agent mixing chamber attachment interface 146, the cleaning agent mixing chamber attachment interface 146 being located on a back side of the transparent cleaning agent mixing chamber 140.

Figure 20:
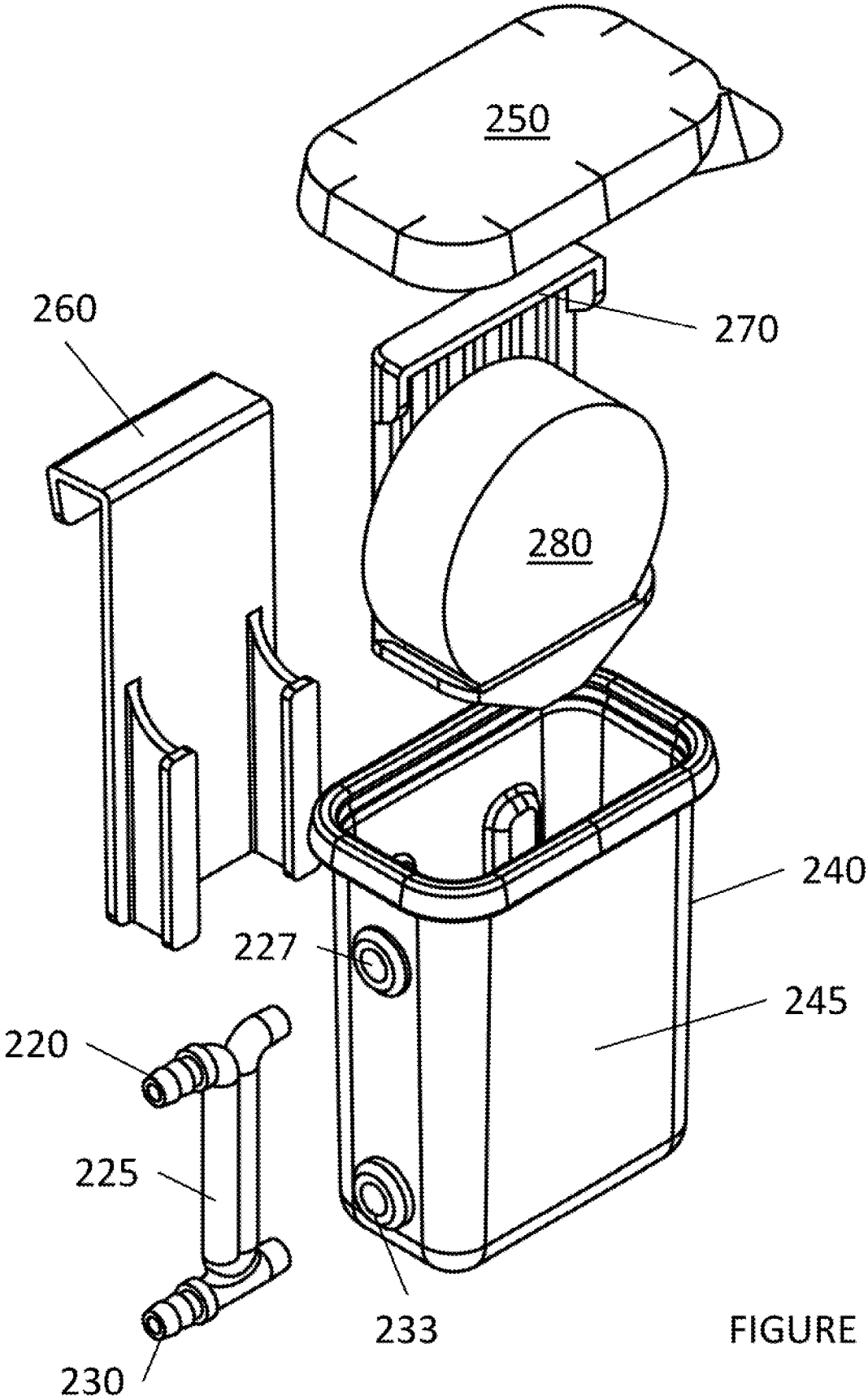
FIG. 20 illustrates another view of a cleaning agent dispensing system.

FIG. 20 illustrates another view of a cleaning agent dispensing system. As illustrated in FIG. 20, a cleaning agent dispensing system includes a cleaning agent mixing chamber 240 for mixing water with a cleaning agent tablet 280 held by a tablet cradle 270. The cleaning agent dispensing system is configured to attach to a wall of a toilet water tank (not shown) via clip mechanism 260. The cleaning agent dispensing system also includes a lid 250 configured to cover and seal the cleaning agent mixing chamber 240.

The cleaning agent dispensing system includes an inlet port 220 for receiving water (see arrow for water flow direction) from a fill valve (not shown) via a tube (not shown). The cleaning agent mixing chamber 240 includes a mixing chamber inlet port 227 for enabling water received by the inlet port 220 to enter the cleaning agent mixing chamber 240. Between the inlet port 220 and the mixing chamber inlet port 227, a trap 225 is located to prevent gases from the cleaning agent solution or the cleaning agent solution, itself, from travelling back towards the fill valve (not shown).

The cleaning agent dispensing system includes an outlet port 230 for outputting cleaning agent solution (see arrow for cleaning agent solution flow direction) to an overflow tube (not shown) via a tube (not shown). The cleaning agent mixing chamber 240 includes a mixing chamber outlet port 233 for enabling the cleaning agent solution in the cleaning agent mixing chamber 240 to exit to the overflow tube (not shown).

Based upon the configuration of the mixing chamber inlet port and the mixing chamber outlet port, the trap remains filled with clean incoming water from the filler valve (not shown) after a flush operation, and the water remaining in trap 225, after the flush operation, does not mingle with the cleaning solution because all but a small residual of the cleaning agent solution exits the transparent cleaning agent mixing chamber during the flush operation such that the water level of the cleaning agent solution does not reach the bottom of the mixing chamber inlet port during a flush operation.

Figure 21:
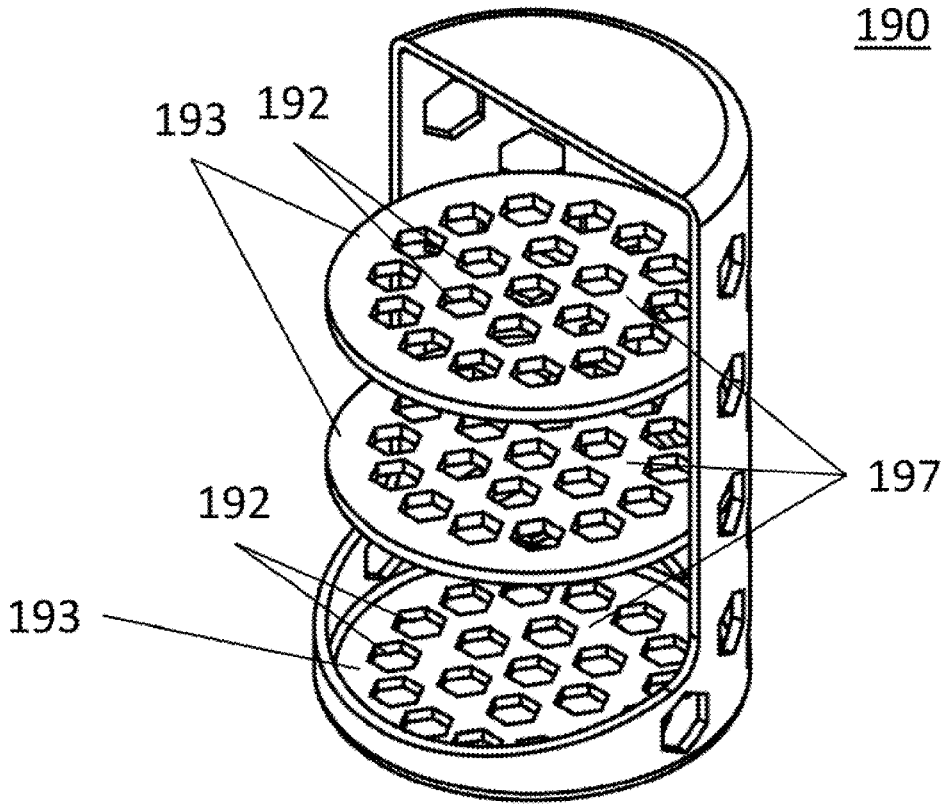
FIG. 21 illustrates a perspective view of another embodiment of a tablet cradle.

FIG. 21 illustrates a perspective view of another embodiment of a tablet cradle. As illustrated in FIG. 21, a tablet cradle 190 includes a cradle floor 193 having multiple apertures 192 to allow water/solution to flow therethrough. The tablet cradle 190 also has multiple tablet cradle shelves 193 attached to a back side of the tablet cradle 190. Each tablet cradle shelf 193 has multiple apertures 192 to allow water/solution to flow therethrough. Each tablet cradle shelf 193 projects from the back side of the tablet cradle 190 into opening 197, which allows a substantially unobstructed view of cleaning agent tablets (not shown) in the tablet cradle 190, while the tablet cradle 190 is located within a transparent cleaning agent mixing chamber. Opening 197 is configured to enable easy access, through opening 197, to cleaning agent tablets (not shown) in tablet cradle 190.

Figure 22:
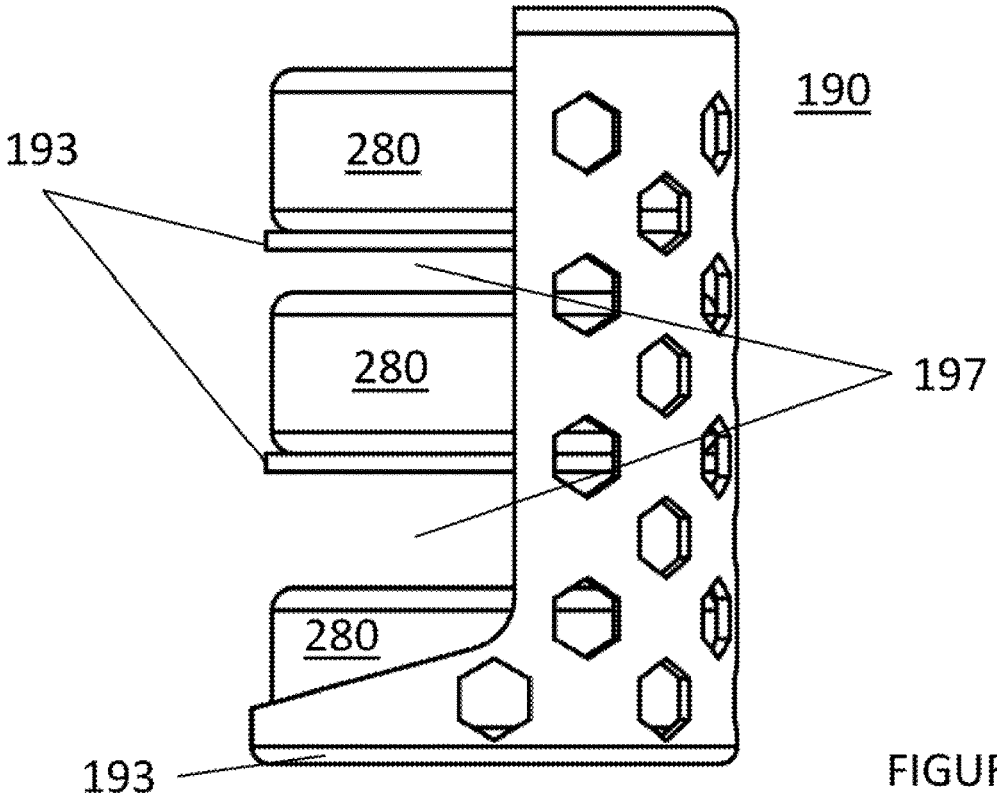
FIG. 22 illustrates a side view of the tablet cradle of FIG. 21.

FIG. 22 illustrates a side view of the tablet cradle of FIG. 21. As illustrated in FIG. 22, a tablet cradle 190 includes a cradle floor 193 having multiple apertures to allow water/solution to flow therethrough. The tablet cradle 190 also has multiple tablet cradle shelves 193 attached to a back side of the tablet cradle 190.

Each tablet cradle shelf 193 has multiple apertures to allow water/solution to flow therethrough. Each tablet cradle shelf 193 projects from the back side of the tablet cradle 190 into opening 197, which allows a substantially unobstructed view of cleaning agent tablets 280 in the tablet cradle 190, while the tablet cradle 190 is located within a transparent cleaning agent mixing chamber. Opening 197 is configured to enable easy access, through opening 197, to cleaning agent tablets 280 in tablet cradle 190.

Figure 23:
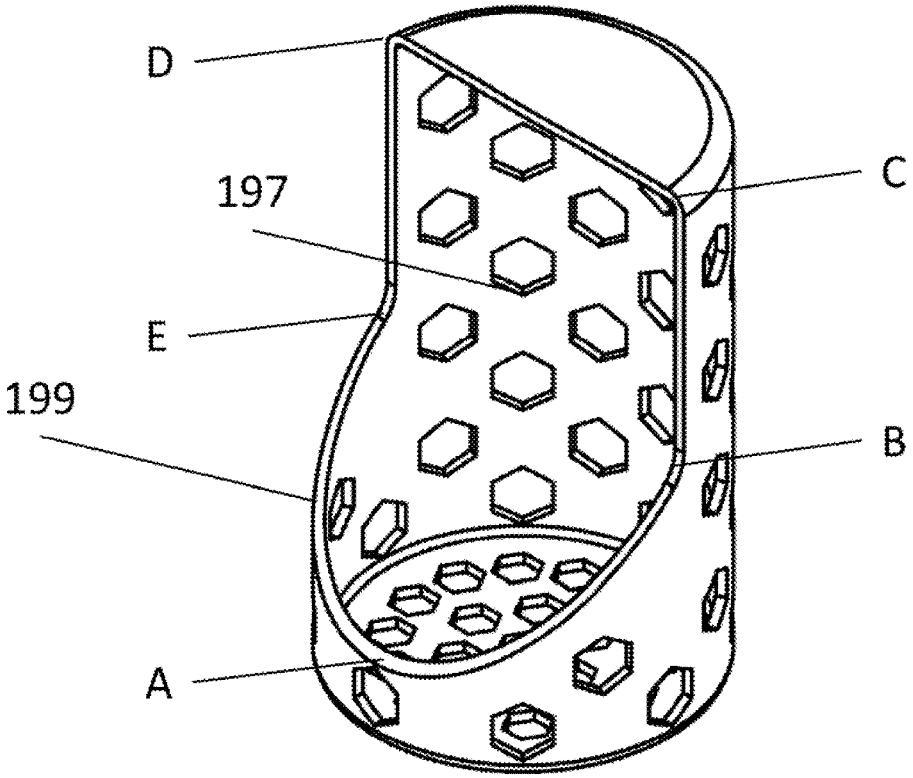
FIG. 23 illustrates a perspective view of a boundary of an opening in the tablet cradle of FIGS. 5 and 8.

FIG. 23 illustrates a perspective view of a boundary of an opening in the tablet cradle of FIGS. 5 and 8. As illustrated in FIG. 23, a tablet cradle includes a three-dimensional opening 197 formed by edge 199, as opposed to an opening in a cleaning agent mixing chamber, which is two-dimensional. The edge 199 has a first edge portion defined by a surface edge between point A and point B. The edge 199 has a second edge portion defined by a surface edge between point B and point C. The edge 199 has a third edge portion defined by a surface edge between point C and point D. The edge 199 has a fourth edge portion defined by a surface edge between point D and point E. The edge 199 has a fifth edge portion defined by a surface edge between point E and point A.

The first edge portion, defined by a surface edge between point A and point B, has a substantially three-dimensional arc shape. More specifically, the surface edge, as the surface is traversed from point A to point B, follows an arc path from a front side of the tablet cradle to a first side of the tablet cradle, while also following a path from a floor of the tablet cradle to a top of the tablet cradle.

The second edge portion, defined by a surface edge between point B and point C, has a substantially one-dimensional straight shape. More specifically, the surface edge, as the surface is traversed from point B to point C, follows a substantially straight from a floor of the tablet cradle to a top of the tablet cradle.

The third edge portion, defined by a surface edge between point C and point D, has a substantially one-dimensional straight shape. More specifically, the surface edge, as the surface is traversed from point C to point D, follows a substantially straight from a first side of the tablet cradle to a second side of the tablet cradle.

The fourth edge portion, defined by a surface edge between point D and point E, has a substantially one-dimensional straight shape. More specifically, the surface edge, as the surface is traversed from point D to point E, follows a substantially straight from a top of the tablet cradle to a floor of the tablet cradle.

The fifth edge portion, defined by a surface edge between point E and point A, has a substantially three-dimensional arc shape. More specifically, the surface edge, as the surface is traversed from point E to point A, follows an arc path from a second side of the tablet cradle to a front side of the tablet cradle, while also following a path from a top of the tablet cradle to a floor of the tablet cradle.

Figure 24:
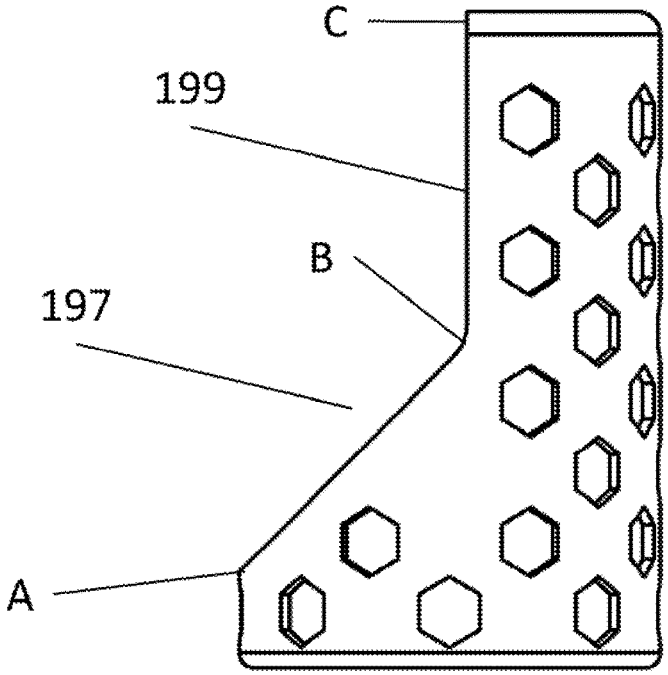
FIG. 24 illustrates a first side view of the boundary of the opening in the tablet cradle of FIG. 23.

FIG. 24 illustrates a first side view of the boundary of the opening in the tablet cradle of FIG. 23. As illustrated in FIG. 24, a tablet cradle includes a three-dimensional opening 197 formed by edge 199. The edge 199 has a first edge portion defined by a surface edge between point A and point B. The edge 199 has a second edge portion defined by a surface edge between point B and point C.

The first edge portion, defined by a surface edge between point A and point B, has a substantially three-dimensional arc shape. More specifically, the surface edge, as the surface is traversed from point A to point B, follows an arc path from a front side of the tablet cradle to a first side of the tablet cradle, while also following a path from a floor of the tablet cradle to a top of the tablet cradle.

The second edge portion, defined by a surface edge between point B and point C, has a substantially one-dimensional straight shape. More specifically, the surface edge, as the surface is traversed from point B to point C, follows a substantially straight from a floor of the tablet cradle to a top of the tablet cradle.

Figure 25:
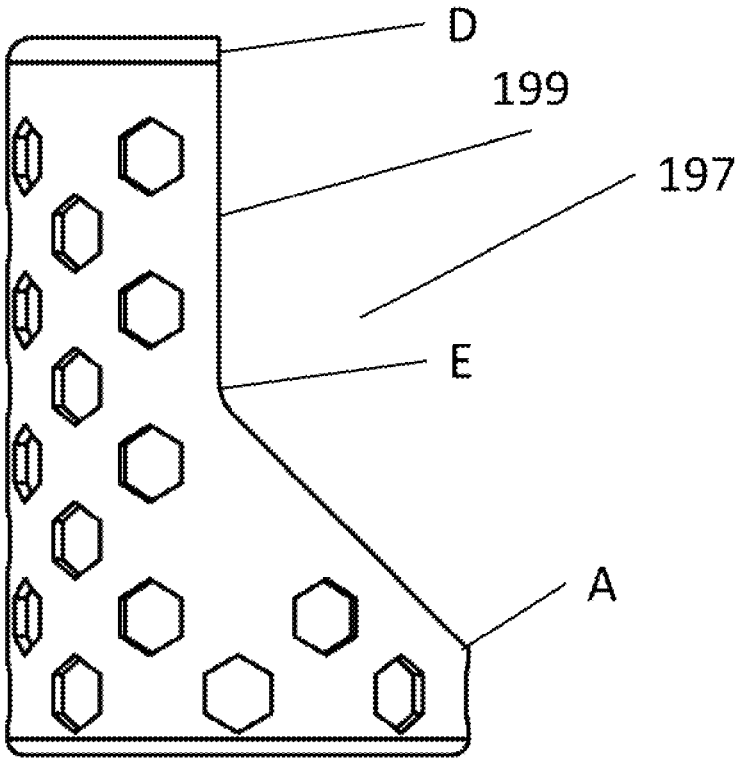
FIG. 25 illustrates a second side view of the boundary of the opening in the tablet cradle of FIG. 23.

FIG. 25 illustrates a second side view of the boundary of the opening in the tablet cradle of FIG. 23. As illustrated in FIG. 25, a tablet cradle includes a three-dimensional opening 197 formed by edge 199. The edge 199 has a fourth edge portion defined by a surface edge between point D and point E. The edge 199 has a fifth edge portion defined by a surface edge between point E and point A.

The fourth edge portion, defined by a surface edge between point D and point E, has a substantially one-dimensional straight shape. More specifically, the surface edge, as the surface is traversed from point D to point E, follows a substantially straight from a top of the tablet cradle to a floor of the tablet cradle.

The fifth edge portion, defined by a surface edge between point E and point A, has a substantially three-dimensional arc shape. More specifically, the surface edge, as the surface is traversed from point E to point A, follows an arc path from a second side of the tablet cradle to a front side of the tablet cradle, while also following a path from a top of the tablet cradle to a floor of the tablet cradle.

Figure 26:
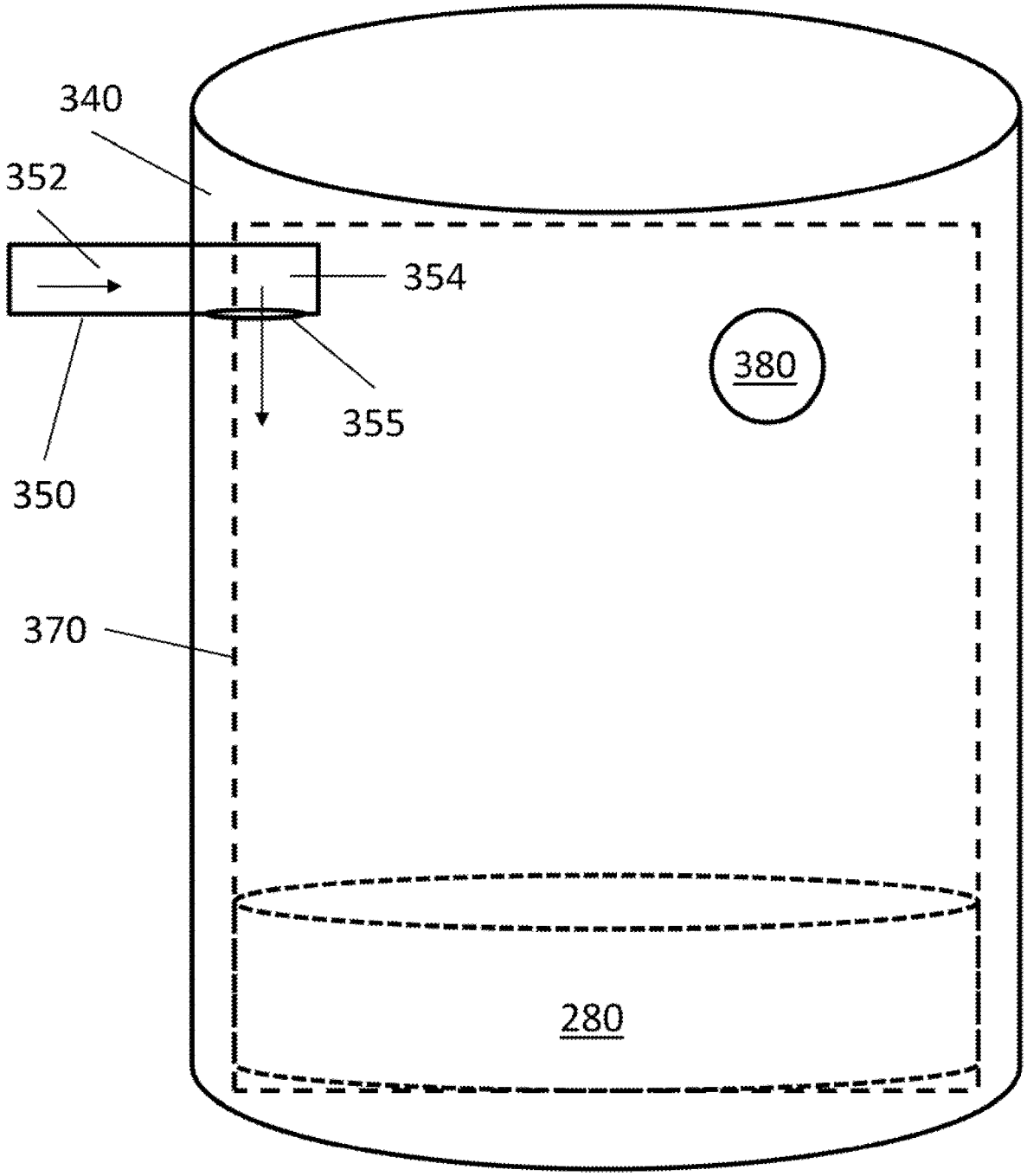
FIG. 26 illustrates a side view of another embodiment of a cleaning agent mixing chamber for a cleaning agent dispensing system.

FIG. 26 illustrates a side view of another embodiment of a cleaning agent mixing chamber for a cleaning agent dispensing system. As illustrated in FIG. 26, a cleaning agent mixing chamber 340 has contained therein a tablet cradle 370 holding a cleaning agent tablet 280.

An inlet member 350 is connected at a top portion of the cleaning agent mixing chamber 340. The inlet member 350 is configured to receive water from a fill valve (not shown) and output the received water inside of the cleaning agent mixing chamber 340.

An outlet member 380 is connected at a top portion of the cleaning agent mixing chamber 340. The outlet member 380 is configured to dispense/output cleaning agent solution in the cleaning agent mixing chamber 340 to an overflow tube (not shown) of the toilet via a tube (not shown).

The inlet member 350 includes an inlet portion 352 located outside the cleaning agent mixing chamber 340. The inlet portion 352 is configured to interface with a tube (not shown) connected to the fill valve (not shown) so as to receive water from the fill valve (not shown).

The inlet member 350 also includes an outlet portion 354 located inside the cleaning agent mixing chamber 340. The outlet portion 354 is configured to direct the received water in a path parallel to a side wall of the cleaning agent mixing chamber 340. As illustrated in FIG. 26, an opening 355 located on an underside of outlet portion 354 directs the received water downward towards a floor of the cleaning agent mixing chamber 340 in a path that is parallel to a side wall of the cleaning agent mixing chamber 340.

It is noted that the position of the outlet member 380 may be closer to a floor of the cleaning agent mixing chamber 340 than a position of the inlet member 370. This allows the level of the cleaning agent solution to be below the position of the inlet member 370 during non-flushing operations, thereby preventing the cleaning agent solution from being siphoned back towards the fill valve (not shown).

Figure 27:
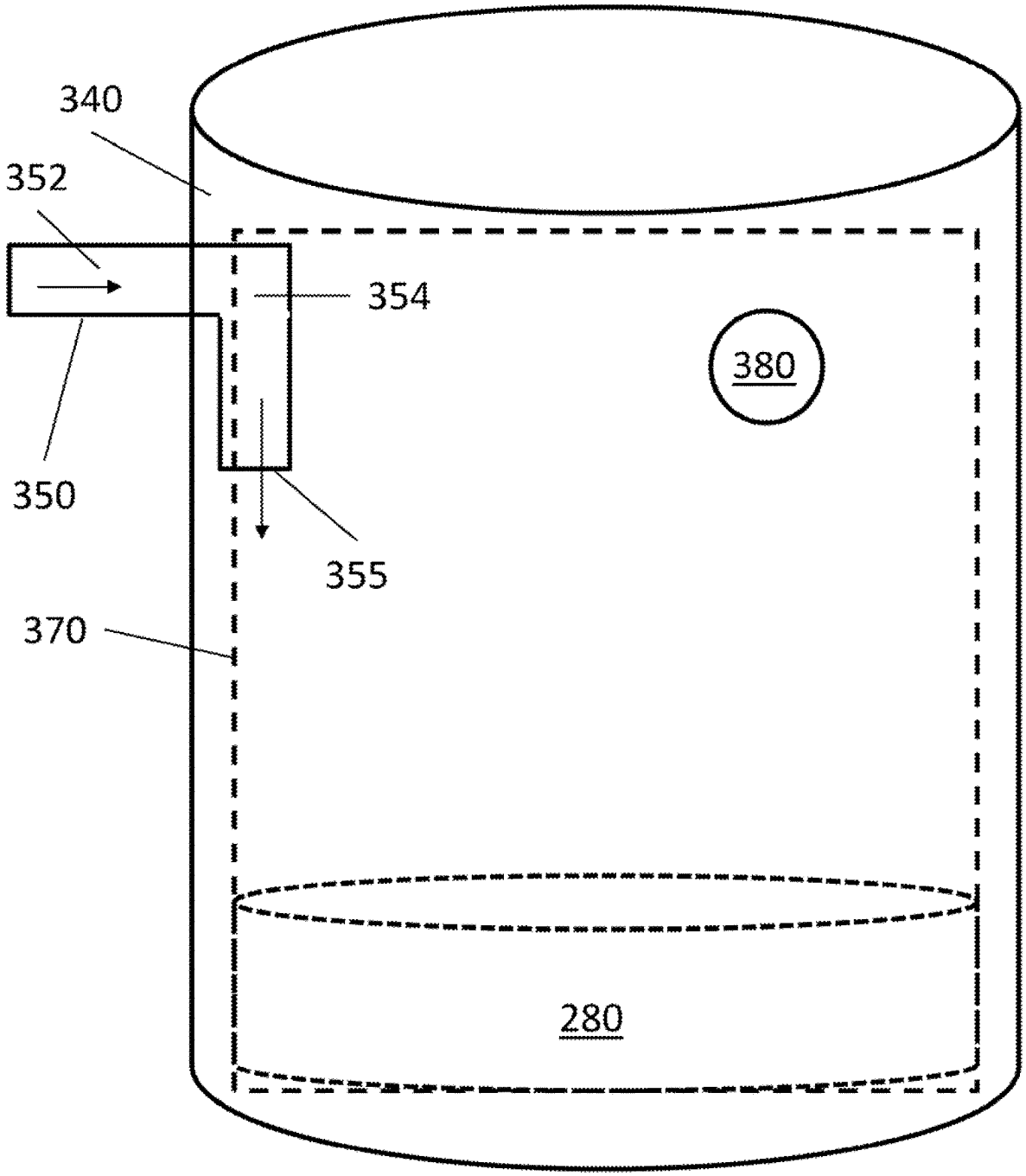
FIG. 27 illustrates a side view of another embodiment of a cleaning agent mixing chamber for a cleaning agent dispensing system.

FIG. 27 illustrates a side view of another embodiment of a cleaning agent mixing chamber for a cleaning agent dispensing system. As illustrated in FIG. 27, a cleaning agent mixing chamber 340 has contained therein a tablet cradle 370 holding a cleaning agent tablet 280.

An inlet member 350 is connected at a top portion of the cleaning agent mixing chamber 340. The inlet member 350 is configured to receive water from a fill valve (not shown) and output the received water inside of the cleaning agent mixing chamber 340.

An outlet member 380 is connected at a top portion of the cleaning agent mixing chamber 340. The outlet member 380 is configured to dispense/output cleaning agent solution in the cleaning agent mixing chamber 340 to an overflow tube (not shown) of the toilet via a tube (not shown).

The inlet member 350 includes an inlet portion 352 located outside the cleaning agent mixing chamber 340. The inlet portion 352 is configured to interface with a tube (not shown) connected to the fill valve (not shown) so as to receive water from the fill valve (not shown).

The inlet member 350 also includes an outlet portion 354 located inside the cleaning agent mixing chamber 340. The outlet portion 354 has, as illustrated, an L-shape or elbow shape. The shape of the outlet portion 354 is configured to direct the received water in a path parallel to a side wall of the cleaning agent mixing chamber 340.

As illustrated in FIG. 27, an opening 355 at an end of the outlet portion 354 directs the received water directly downward towards a floor of the cleaning agent mixing chamber 340 in a path that is parallel to a side wall of the cleaning agent mixing chamber 340.

It is noted that the position of the outlet member 380 may be closer to a floor of the cleaning agent mixing chamber 340 than a position of the inlet member 370. This allows the level of the cleaning agent solution to be below the position of the inlet member 370 during non-flushing operations, thereby preventing the cleaning agent solution from being siphoned back towards the fill valve (not shown).

It is noted that the outlet portion 354 can be positioned such that the opening 355 at the end of the outlet portion 354 directs the received water non-directly downward towards a floor of the cleaning agent mixing chamber 340 in a path that is parallel to a side wall of the cleaning agent mixing chamber 340.

In the embodiments illustrated in FIGS. 26 and 27, the three-dimensional opening of the tablet cradle can be modified or configured to have the tablet cradle clear the inlet portion of the inlet member.

Figure 28:
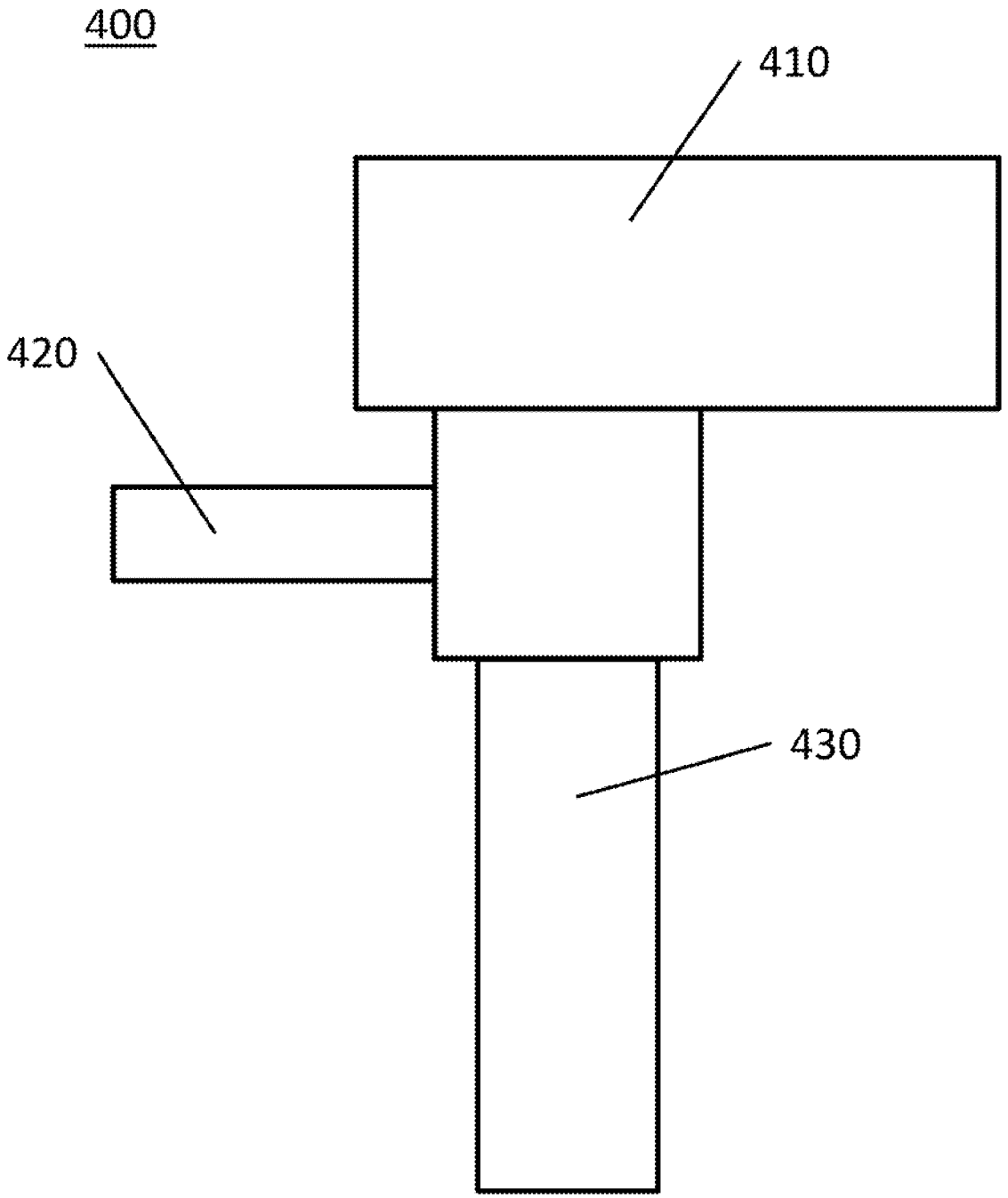
FIGURE 28 (Prior Art)
FIG. 28 illustrates a prior art flushing mechanism.

FIG. 28 illustrates a prior art flushing mechanism. As illustrated in FIG. 28, a flushing mechanism 400 includes a flush valve housing 410, a flushing arm 420, and a vacuum breaker tube 430. The flush valve housing 410 is connected to a fluid (water) source (not shown) and contains a valve (not shown) to control the flow of a fluid from the source (not shown) to a toilet or urinal (not shown). The valve is triggered to an open state upon activation of the flushing arm 420. The vacuum breaker tube 430 connects flush valve housing 410 to a toilet or urinal (not shown). The vacuum breaker tube 430 prevents grey water from contaminating the fresh water supply.

Figure 29:
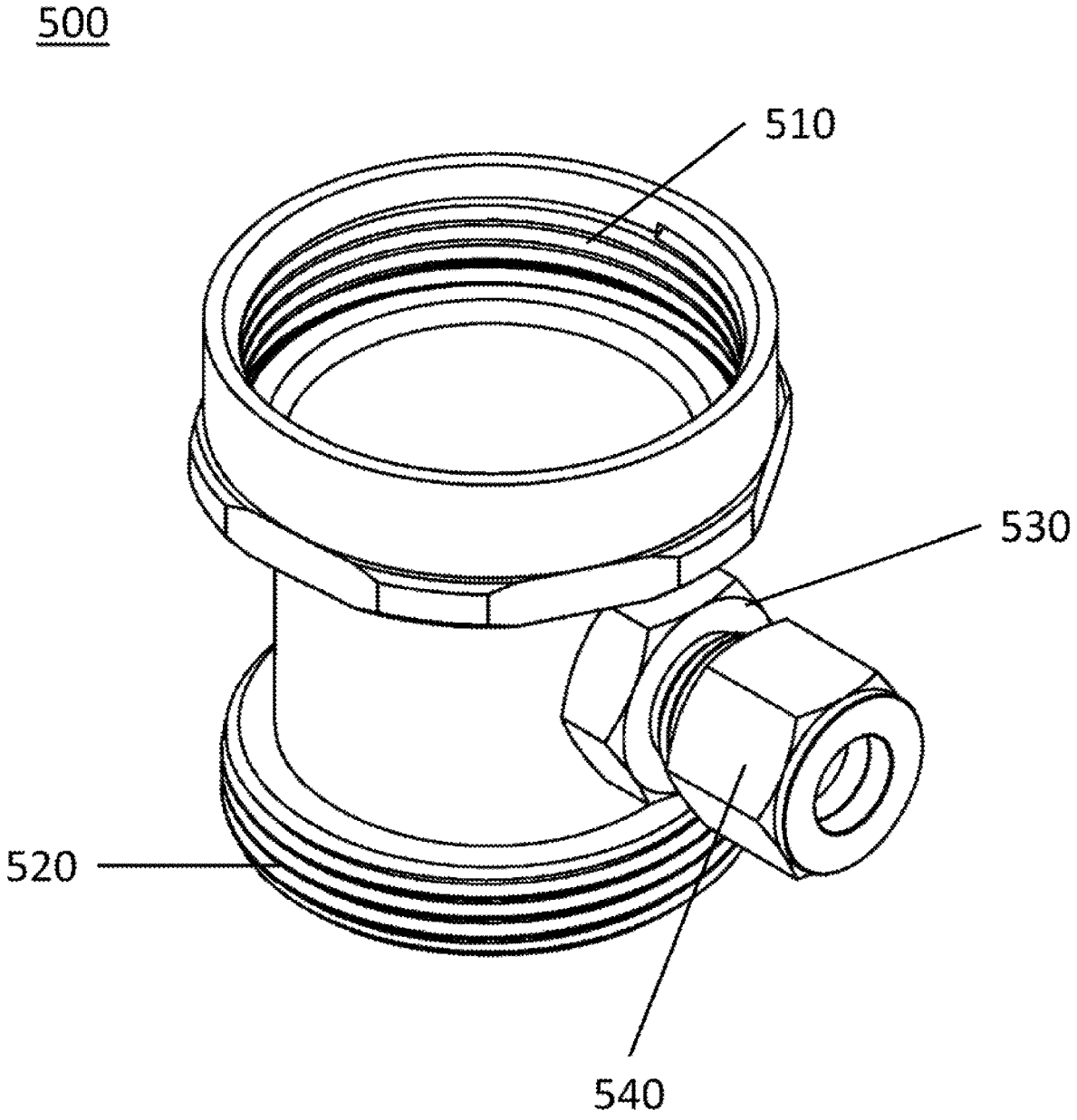
FIG. 29 illustrates a flush valve adapter.

FIG. 29 illustrates a flush valve adapter. As illustrated in FIG. 29, a flush valve adapter 500 includes a first threaded interface 510 for engaging and connecting to a corresponding interface of a flush valve housing (not shown). The flush valve adapter 500 also includes a second threaded interface 520 for engaging and connecting to a corresponding interface of a vacuum breaker tube (not shown). Between the first threaded interface 510 and the second threaded interface 520, the flush valve adapter 500 includes an outlet 530 with a corresponding coupling member 540. The outlet 530 is configured to allow fluid (water) to leave or exit the flush valve adapter 500. The coupling member 540 is configured to engage and connect to a conduit (not shown), which is connected to a cleaning agent mixing chamber (not shown).

It is noted that the outlet 530 may include a one-way valve to prevent fluid from entering the flush valve adapter 500 from the connected conduit (not shown).

Figure 30:
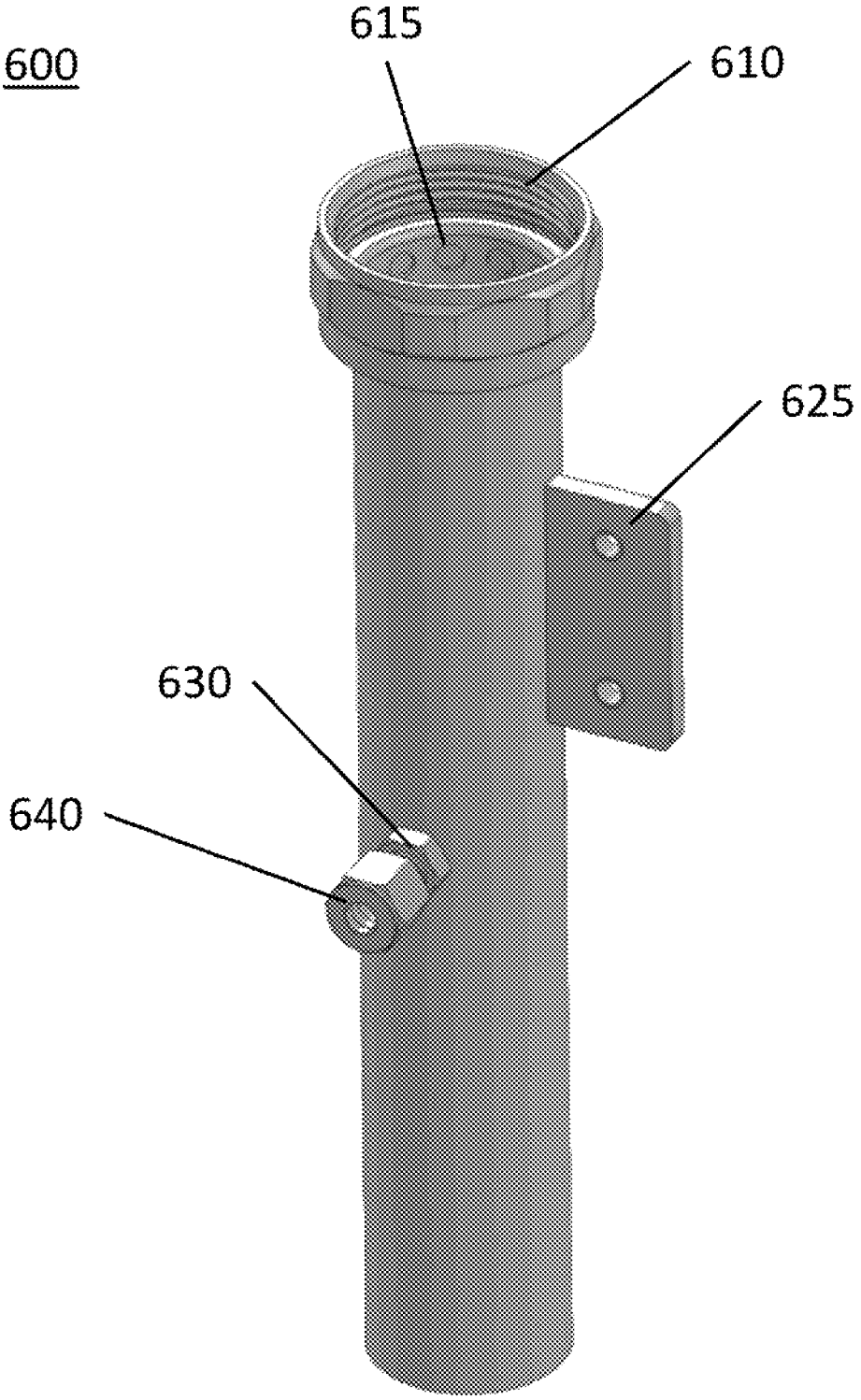
FIG. 30 illustrates a vacuum breaker adapter.

FIG. 30 illustrates a vacuum breaker adapter. As illustrated in FIG. 30, a vacuum breaker adapter 600 includes a first threaded interface 610 for engaging and connecting to the corresponding second threaded interface of the flush valve adapter of FIG. 29. The vacuum breaker adapter 600 also includes a vacuum breaker 615 for prevents grey water from contaminating the fresh water supply. Below the vacuum breaker 615, the vacuum breaker adapter 600 includes an inlet 630 with a corresponding coupling member 640. The inlet 630 is configured to allow fluid (water) to enter the vacuum breaker adapter 600. The coupling member 640 is configured to engage and connect to a conduit (not shown), which is connected to a cleaning agent mixing chamber (not shown).

It is noted that the inlet 630 may include a one-way valve to prevent fluid from leaving the vacuum breaker adapter 600 and entering the connected conduit (not shown).

The vacuum breaker adapter 600 includes a cleaning agent mixing chamber interface member 625. The cleaning agent mixing chamber interface member 625 is configured to enable a cleaning agent mixing chamber (not shown) to be securely attached to the vacuum breaker adapter 600 and configured to mechanically support a cleaning agent mixing chamber (not shown).

Figure 31:
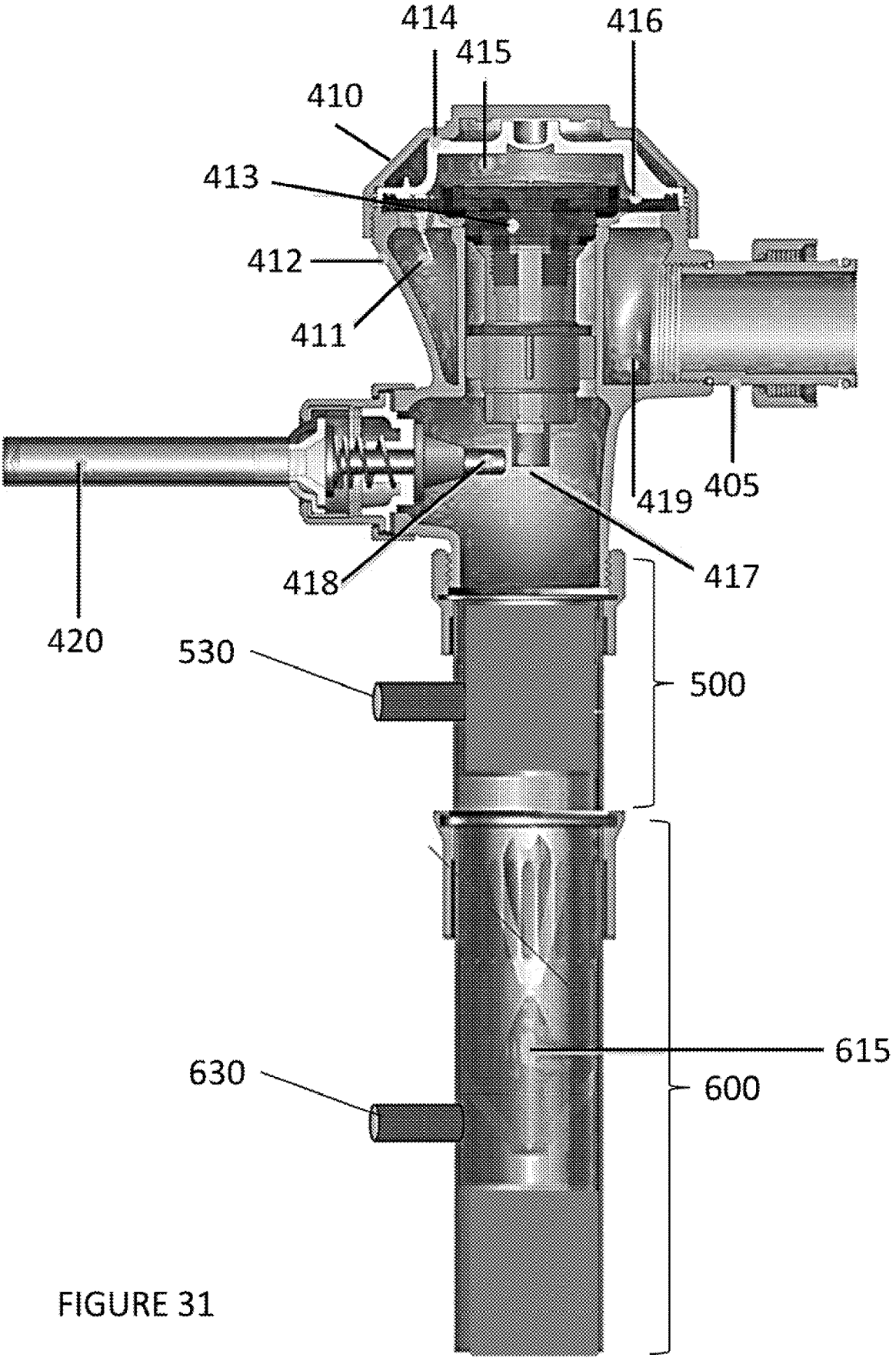
FIG. 31 illustrates a flush valve adapter and a vacuum breaker adapter in conjunction with a flushing mechanism.

FIG. 31 illustrates a flush valve adapter and a vacuum breaker adapter in conjunction with a flushing mechanism. As illustrated in FIG. 31, a flushing mechanism is connected to a tailpipe 405 and includes a flush valve housing 410 and a flushing arm 420. The flushing mechanism further includes a wiper spring 411, dezincification-resistant shell 412, a diaphragm 413, an inner cover 414, an upper chamber 415, another diaphragm 416, a relief valve 417, a handle pin 418, and a lower chamber 419. The flush valve housing 410 is mechanically connected to a flush valve adapter 500 including an outlet 530. The flush valve adapter 500 is mechanically connected to a vacuum breaker adapter 600 including a vacuum breaker 615 and an inlet 630.

Figure 32:
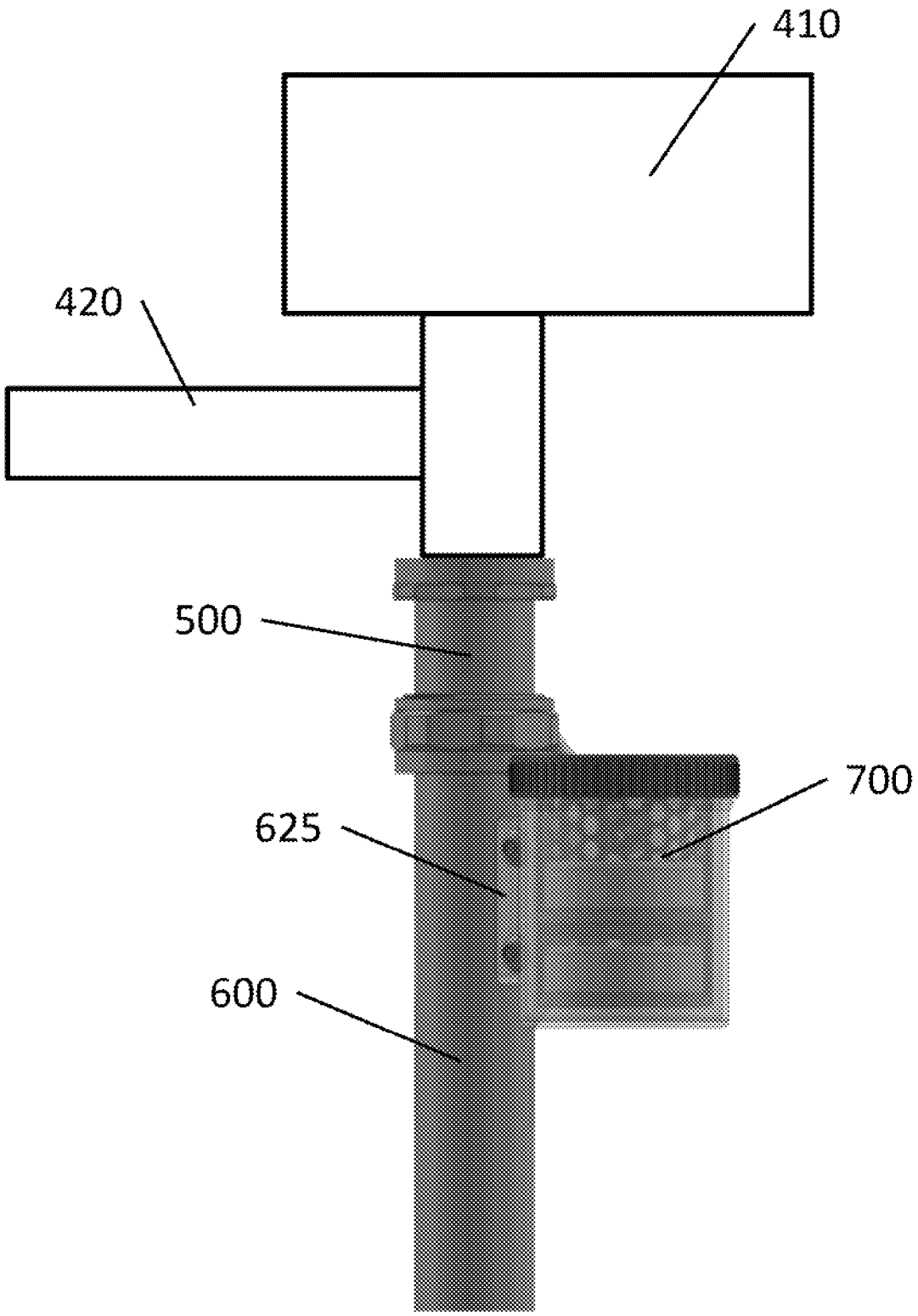
FIG. 32 illustrates a front view of a toilet cleaning system.

FIG. 32 illustrates a front view of a toilet cleaning system. As illustrated in FIG. 32, a toilet cleaning system includes a flush valve housing 410 and a flushing arm 420. The flush valve housing 410 is mechanically connected to a flush valve adapter 500. The flush valve adapter 500 is mechanically connected to a vacuum breaker adapter 600 including a cleaning agent mixing chamber interface member 625. The cleaning agent mixing chamber interface member 625 is mechanically connected to a cleaning agent mixing chamber 700.

The cleaning agent mixing chamber 700 includes a transparent cleaning agent mixing chamber for mixing water with cleaning agent tablets. The cleaning agent mixing chamber is configured to attach to the cleaning agent mixing chamber interface member 625, via bolts and nuts or other attachment mechanisms. The cleaning agent mixing chamber 700 also includes a lid configured to cover and seal the transparent cleaning agent mixing chamber.

The cleaning agent mixing chamber 700 includes an inlet port for receiving water from the flush valve adapter 500. The transparent cleaning agent mixing chamber includes a mixing chamber inlet port for enabling water received by the inlet port to enter the transparent cleaning agent mixing chamber. Between the inlet port and the mixing chamber inlet port, a one-way valve may be located to prevent fluid from entering the flush valve adapter 500 from the cleaning agent mixing chamber 700.

The cleaning agent dispensing system includes an outlet port for outputting cleaning agent solution to the vacuum breaker adapter 600.

Figure 33:
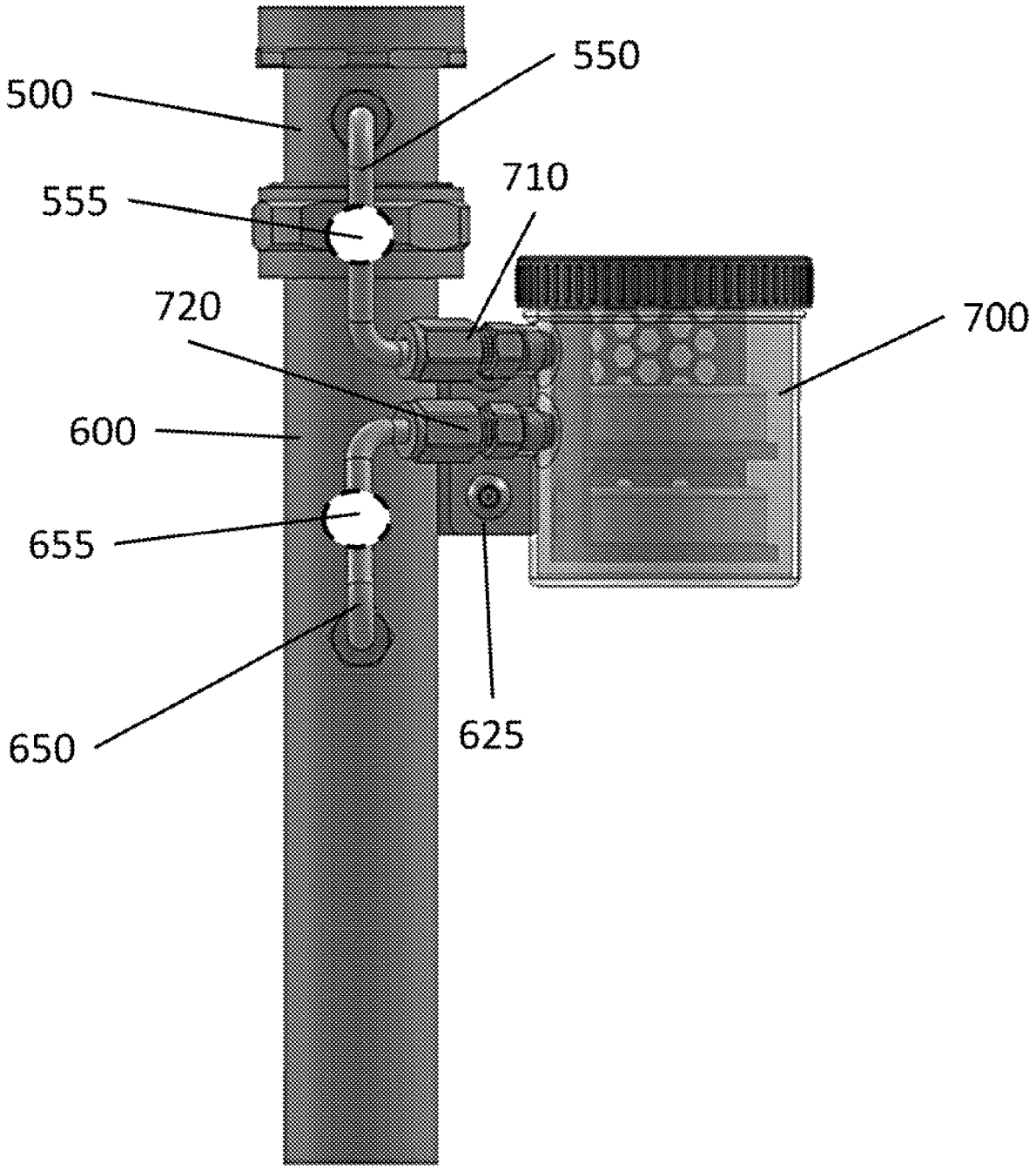
FIG. 33 illustrates a back view of the toilet cleaning system of FIG. 32.

FIG. 33 illustrates a back view of the toilet cleaning system of FIG. 32. As illustrated in FIG. 33, a toilet cleaning system includes a flush valve adapter 500. The flush valve adapter 500 is mechanically connected to a vacuum breaker adapter 600 including a cleaning agent mixing chamber interface member 625. The cleaning agent mixing chamber interface member 625 is mechanically connected to a cleaning agent mixing chamber 700.

The cleaning agent mixing chamber 700 includes a transparent cleaning agent mixing chamber for mixing water with cleaning agent tablets. The cleaning agent mixing chamber is configured to attach to the cleaning agent mixing chamber interface member 625, via bolts and nuts or other attachment mechanisms. The cleaning agent mixing chamber 700 also includes a lid configured to cover and seal the transparent cleaning agent mixing chamber.

The cleaning agent mixing chamber 700 includes an inlet port 710 for receiving water from the flush valve adapter 500, via conduit 550. The transparent cleaning agent mixing chamber includes a mixing chamber inlet port for enabling water received by the inlet port 710 to enter the transparent cleaning agent mixing chamber. Between the inlet port 710 and the mixing chamber inlet port, a one-way valve may be located to prevent fluid from entering the flush valve adapter 500 from the cleaning agent mixing chamber 700.

The cleaning agent dispensing system includes an outlet port 720 for outputting cleaning agent solution to the vacuum breaker adapter 600, via conduit 650.

It is noted that the outlet port 720 may include a one-way valve to prevent fluid from leaving the vacuum breaker adapter 600 and entering the cleaning agent mixing chamber 700.

Figure 34:
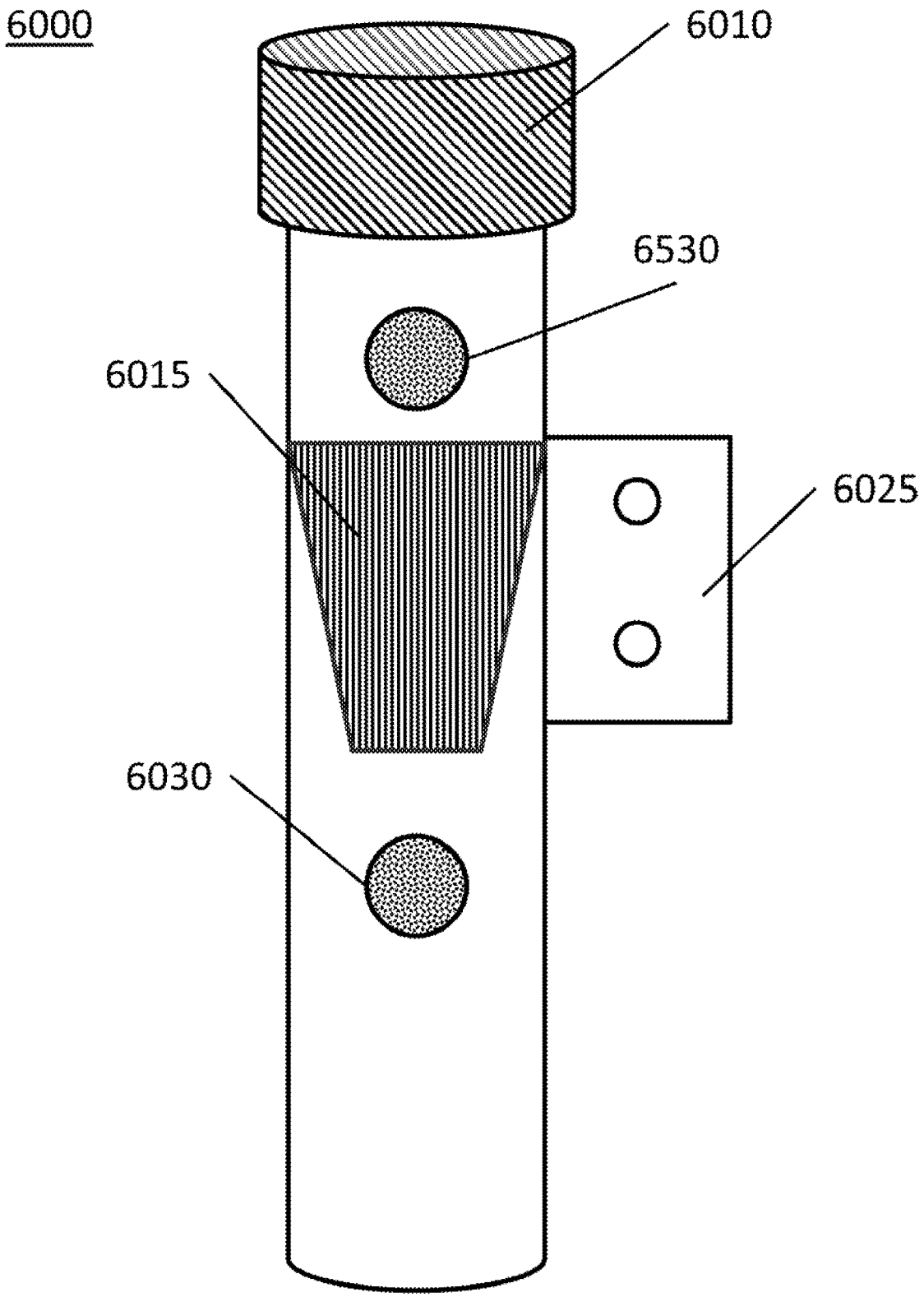
FIG. 34 illustrates another embodiment of a vacuum breaker adapter.

FIG. 34 illustrates another embodiment of a vacuum breaker adapter. As illustrated in FIG. 34, a vacuum breaker adapter 6000 includes a first threaded interface 6010 for engaging and connecting to a corresponding threaded interface of a flush valve housing as illustrated in FIG. 28. The vacuum breaker adapter 6000 also includes a vacuum breaker 6015 for prevents grey water from contaminating the fresh water supply.

Upstream of the vacuum breaker 6015, the vacuum breaker adapter 6000 includes an outlet 6530 with a corresponding coupling member (not shown). The outlet 6530 is configured to allow fluid (water) to leave or exit the vacuum breaker adapter 6000. The coupling member (not shown) is configured to engage and connect to a conduit (not shown), which is connected to a cleaning agent mixing chamber (not shown).

It is noted that the outlet 6530 may include a one-way valve to prevent fluid from entering the vacuum breaker adapter 6000 from the connected conduit (not shown).

Downstream of the vacuum breaker 6015, the vacuum breaker adapter 6000 includes an inlet 6030 with a corresponding coupling member (not shown). The inlet 6030 is configured to allow fluid (water) to enter the vacuum breaker adapter 6000. The coupling member (not shown) is configured to engage and connect to a conduit (not shown), which is connected to a cleaning agent mixing chamber (not shown).

It is noted that the inlet 6030 may include a one-way valve to prevent fluid from leaving the vacuum breaker adapter 6000 and entering the connected conduit (not shown).

The vacuum breaker adapter 6000 also includes a cleaning agent mixing chamber interface member 6025. The cleaning agent mixing chamber interface member 6025 is configured to enable a cleaning agent mixing chamber (not shown) to be securely attached to the vacuum breaker adapter 6000 and configured to mechanically support a cleaning agent mixing chamber (not shown).

It is noted that the cleaning agent dispensing system may include one or more one-way valves (not shown) to prevent grey water or cleaning agent from entering the flush valve housing. These one or more one-way valves may be located anywhere along the fluid pathway between the flush valve housing and the vacuum breaker adapter. For example, one or more one-way valves may be located in the conduits connected to the cleaning agent mixing chamber. Additionally, for example, one or more one-way valves may be located in the inlet and outlet ports of the cleaning agent mixing chamber or the inlet and outlet ports of the flush valve housing, the flush valve adapter, or the vacuum breaker adapter.

A tankless toilet flush valve releases a force of water to the toilet bowl or urinal. As described above, to mix the flow of water with sanitizing cleaners located in the cleaning agent dispensing system, the water must bypass the vacuum breaker, flow into the cleaning agent dispensing system where tablets of sodium hydrochloride are located. After mixing in the cleaning agent dispensing system, the cleaning agent saturated water then leaves the cleaning agent dispensing system into the vacuum breaker adapter that leads the vacuum breaker adapter to the toilet bowl or urinal.

Although the above described embodiments use a flush valve adapter to divert water from the flushing system, the flush valve housing may include an outlet which is directly connected to the cleaning agent dispensing system.

As described above, the toilet cleaning system is configured to avoid tankless toilets flush valve diaphragms and pistons where the cleaning agent (bleach) will eventually destroy the critical working parts. The cleaning agent dispensing system and flush valve adapter, work in tandem, below the commercial valve diaphragm and piston style flush valves. This configuration prevents corrosive cleaning agent (bleach) from contacting the toilet's rubber components, safeguarding against potential damage caused by caustic cleaning and sanitizing agents.

The above described embodiments address the hygiene and sanitation challenges of tankless toilets, providing users with a safer and cleaner environment.

A cleaning agent dispensing system for a toilet includes a cleaning agent mixing chamber configured to mix water with a cleaning agent tablet; and an inlet/outlet member, operatively connected to the cleaning agent mixing chamber, configured to receive water from a fill valve located within a water tank of the toilet and to output cleaning agent solution to an overflow tube located within a water tank of the toilet; the cleaning agent mixing chamber including a mixing chamber inlet port, located at a top portion of the cleaning agent mixing chamber, configured to enable water from the fill valve to enter the cleaning agent mixing chamber, and a mixing chamber outlet port, located at a bottom portion of the cleaning agent mixing chamber, configured to enable cleaning agent solution to be outputted to the overflow tube; the inlet/outlet member including a water inlet port, located at a top portion of the inlet/outlet member, configured to receive water from the fill valve, a water outlet port, located at a top portion of the inlet/outlet member, configured to interface with the mixing chamber inlet port and to deliver water to the cleaning agent mixing chamber, a trap, located between the water inlet port and the water outlet port, to trap water from the fill valve such water remains in the trap after a flushing operation of the toilet, a cleaning agent solution inlet port, located at a bottom portion of the inlet/outlet member, configured to interface with the mixing chamber outlet port and to receive cleaning agent solution from the cleaning agent mixing chamber, and a cleaning agent solution inlet port, located at a bottom portion of the inlet/outlet member, configured to enable cleaning agent solution to be outputted to the overflow tube; the water outlet port and the mixing chamber inlet port being configured in correspondence with the cleaning agent mixing chamber to prevent cleaning agent solution from entering the trap.

The cleaning agent mixing chamber may be transparent.

The cleaning agent mixing chamber may have a transparent wall.

The system may include a tablet cradle configured to hold a cleaning agent tablet within the cleaning agent mixing chamber.

The tablet cradle may include multiple apertures configured to allow water to flow therethrough and a three-dimensional opening configured to enable a substantially unobstructed view of a cleaning agent tablet within the cleaning agent mixing chamber.

The three-dimensional opening may be defined by an edge; the edge having a first edge portion defined by a surface edge between a first point and a second point; the edge having a second edge portion defined by a surface edge between the second point and a third point; the edge having a third edge portion defined by a surface edge between the third point and a fourth point; the edge having a fourth edge portion defined by a surface edge between a fourth point and a fifth point; the edge having a fifth edge portion defined by a surface edge between the fifth point and the first point; the first edge portion having a substantially three-dimensional arc shape; the second edge portion having a substantially one-dimensional straight shape; the third edge portion having a substantially one-dimensional straight shape; the fourth edge portion having a substantially one-dimensional straight shape; the fifth edge portion having a substantially three-dimensional arc shape.

The tablet cradle may include multiple apertures configured to allow water to flow therethrough and an open volume configured to enable a substantially unobstructed view of a cleaning agent tablet within the cleaning agent mixing chamber.

The transparent cleaning agent mixing chamber may include an inlet member configured to receive water and output the received water inside of the cleaning agent mixing chamber; the inlet member including an inlet portion and an outlet portion; the inlet portion being located outside the cleaning agent mixing chamber; the inlet portion being configured to receive water; the outlet portion being located inside the cleaning agent mixing chamber; the outlet portion being configured to direct the received water in a path parallel to a side wall of the cleaning agent mixing chamber; the outlet portion including an opening located on an underside thereof; the opening configured to direct the received water downward towards a floor of the cleaning agent mixing chamber in a path parallel to a side wall of the cleaning agent mixing chamber A cleaning agent dispensing system for a toilet includes a transparent cleaning agent mixing chamber configured to mix water with a cleaning agent tablet; and a tablet cradle configured to hold a cleaning agent tablet within the transparent cleaning agent mixing chamber; the tablet cradle including a housing, multiple apertures, in the housing, configured to allow water to flow therethrough, and a three-dimensional opening, in the housing, configured to enable a substantially unobstructed view of a cleaning agent tablet within the transparent cleaning agent mixing chamber.

The tablet cradle may include multiple tablet shelves, having apertures therein, configured to hold multiple cleaning agent tablets within the transparent cleaning agent mixing chamber.

The three-dimensional opening may be defined by an edge; the edge having a first edge portion defined by a surface edge between a first point and a second point; the edge having a second edge portion defined by a surface edge between the second point and a third point; the edge having a third edge portion defined by a surface edge between the third point and a fourth point; the edge having a fourth edge portion defined by a surface edge between a fourth point and a fifth point; the edge having a fifth edge portion defined by a surface edge between the fifth point and the first point; the first edge portion having a substantially three-dimensional arc shape; the second edge portion having a substantially one-dimensional straight shape; the third edge portion having a substantially one-dimensional straight shape; the fourth edge portion having a substantially one-dimensional straight shape; the fifth edge portion having a substantially three-dimensional arc shape.

The system may include comprising an integrated lid; the integrated lid being integrated to the housing; the integrated lid and the housing being configured such that when the integrated lid is properly engaged with a transparent cleaning agent mixing chamber of a cleaning agent dispensing system, the three-dimensional opening corresponds to a front side of the transparent cleaning agent mixing chamber.

The transparent cleaning agent mixing chamber may include a notch located on a back side of the transparent cleaning agent mixing chamber; the housing including a groove located on a back side of the housing; the groove being configured to interface with the notch; the notch and the groove being configured such that when the tablet cradle is located in the transparent cleaning agent mixing chamber, the three-dimensional opening corresponds to a front side of the transparent cleaning agent mixing chamber.

A tablet cradle for a cleaning agent dispensing system for a toilet includes a housing; multiple apertures, in the housing, configured to allow water to flow therethrough; and a three-dimensional opening, in the housing, configured to enable a substantially unobstructed view of a cleaning agent tablet within a transparent cleaning agent mixing chamber.

The tablet cradle may include multiple tablet shelves, having apertures therein, configured to hold multiple cleaning agent tablets within the transparent cleaning agent mixing chamber.

The three-dimensional opening may be defined by an edge; the edge having a first edge portion defined by a surface edge between a first point and a second point; the edge having a second edge portion defined by a surface edge between the second point and a third point; the edge having a third edge portion defined by a surface edge between the third point and a fourth point; the edge having a fourth edge portion defined by a surface edge between a fourth point and a fifth point; the edge having a fifth edge portion defined by a surface edge between the fifth point and the first point; the first edge portion having a substantially three-dimensional arc shape; the second edge portion having a substantially one-dimensional straight shape; the third edge portion having a substantially one-dimensional straight shape; the fourth edge portion having a substantially one-dimensional straight shape; the fifth edge portion having a substantially three-dimensional arc shape.

The tablet cradle may include an integrated lid; the integrated lid being integrated to the housing; the integrated lid and the housing being configured such that when the integrated lid is properly engaged with a transparent cleaning agent mixing chamber of a cleaning agent dispensing system, the three-dimensional opening corresponds to a front side of the transparent cleaning agent mixing chamber.

The housing may include a groove located on a back side of the housing; the groove being configured to interface with a notch located on a back side of a transparent cleaning agent mixing chamber of a cleaning agent dispensing system; the groove and the notch being configured such that when the tablet cradle is located in the transparent cleaning agent mixing chamber of the cleaning agent dispensing system, the three-dimensional opening corresponds to a front side of the transparent cleaning agent mixing chamber.

A flush valve adapter for a tankless toilet having a flush valve housing and a vacuum breaker member includes a conduit body having a first end and a second end; a female threaded interface located at the first end of the conduit body; a male threaded interface located at the second end of the conduit body; and an outlet port member located in the conduit body between the female threaded interface and the male threaded interface; the female threaded interface being configured to couple to a threaded outlet of the flush valve housing of the tankless toilet; the male threaded interface being configured to couple to the vacuum breaker member; the outlet port member being configured to couple to a conduit.

The outlet port member may include a one-way valve mechanism configured to allow fluid to only flow from the conduit body.

The outlet port member may include a metering mechanism configured to meter an amount of fluid leaving the conduit body.

The outlet port member may be integral to the conduit body.

A vacuum breaker adapter for a tankless toilet having a flush valve housing, includes a conduit body having a first end and a second end; a female threaded interface located at the first end of the conduit body; a vacuum breaker mechanism located in the conduit body; an inlet port member located on the conduit body downstream of the vacuum breaker mechanism; and a cleaning agent mixing chamber interface member located on the conduit body between the first end and the second end; the inlet port member being configured to couple to a conduit; the cleaning agent mixing chamber interface member being configured to securely attach a cleaning agent mixing chamber thereto.

The inlet port member may include a one-way valve mechanism configured to allow fluid to only flow into the conduit body.

The inlet port member may include a metering mechanism configured to meter an amount of fluid entering the conduit body.

The inlet port member may be integral to the conduit body.

The vacuum breaker adapter may include an outlet port located on the conduit body upstream of the vacuum breaker mechanism; the outlet port member being configured to couple to a conduit.

The inlet port member may include a one-way valve mechanism configured to allow fluid to only flow into the conduit body.

The inlet port member may include a metering mechanism configured to meter an amount of fluid entering the conduit body.

The inlet port member may be integral to the conduit body.

A cleaning agent dispensing system for a tankless toilet having a flush valve housing includes a flush valve adapter; a vacuum breaker adapter; a first conduit; a second conduit; and a cleaning agent dispensing member; the flush valve adapter including a flush valve adapter conduit body having a first end and a second end, a flush valve adapter female threaded interface located at the first end of the flush valve adapter conduit body, a flush valve adapter male threaded interface located at the second end of the flush valve adapter conduit body, and an outlet port member located in the flush valve adapter conduit body between the flush valve adapter female threaded interface and the flush valve adapter male threaded interface; the vacuum breaker adapter including a vacuum breaker adapter conduit body having a first end and a second end, a vacuum breaker adapter female threaded interface located at the first end of the vacuum breaker adapter conduit body, a vacuum breaker mechanism located at the first end of the vacuum breaker adapter conduit body, an inlet port member located in the vacuum breaker adapter conduit body between the vacuum breaker mechanism and the second end of the vacuum breaker adapter conduit body, and a cleaning agent mixing chamber interface member located on the vacuum breaker adapter conduit body between the vacuum breaker mechanism and the inlet port member; the flush valve adapter female threaded interface being configured to couple to a threaded outlet of the flush valve housing of the tankless toilet; the flush valve adapter male threaded interface being configured to couple to the vacuum breaker adapter; the outlet port member being configured to couple to the first conduit; the inlet port member being configured to couple to the second conduit.

The inlet port member may include a one-way valve mechanism configured to allow fluid to only flow into the vacuum breaker adapter conduit body.

The inlet port member may include a metering mechanism configured to meter an amount of fluid entering the vacuum breaker adapter conduit body.

The outlet port member may include a one-way valve mechanism configured to allow fluid to only flow from the flush valve adapter conduit body.

The outlet port member may include a metering mechanism configured to meter an amount of fluid leaving the flush valve adapter conduit body.

The first conduit may include a trap.

The cleaning agent dispensing member may include a cleaning agent mixing chamber configured to mix water received from the flush valve adapter conduit body with a cleaning agent tablet and a tablet cradle configured to hold a cleaning agent tablet within the transparent cleaning agent mixing chamber.

The tablet cradle may include a housing and multiple apertures, in the housing, configured to allow water to flow therethrough.

The cleaning agent mixing chamber may have a transparent wall.

The tablet cradle may include multiple tablet shelves, having apertures therein, configured to hold multiple cleaning agent tablets within the cleaning agent mixing chamber.

The cleaning agent dispensing member may include a transparent cleaning agent mixing chamber configured to mix water received from the flush valve adapter conduit body with a cleaning agent tablet and a tablet cradle configured to hold a cleaning agent tablet within the transparent cleaning agent mixing chamber.

The tablet cradle may include a housing; multiple apertures, in the housing, configured to allow water to flow therethrough, and a three-dimensional opening, in the housing, configured to enable a substantially unobstructed view of a cleaning agent tablet within the transparent cleaning agent mixing chamber.

The tablet cradle may include multiple tablet shelves, having apertures therein, configured to hold multiple cleaning agent tablets within the cleaning agent mixing chamber.

It will be appreciated that variations of the above-disclosed embodiments and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the description above and the following claims.

What is claimed is:

1. A flush valve adapter for a tankless toilet having a flush valve housing and a vacuum breaker member, comprising:

a conduit body having a first end and a second end;

a female threaded interface located at said first end of said conduit body;

a male threaded interface located at said second end of said conduit body; and an outlet port member located on said conduit body between said female threaded interface and said male threaded interface;

said female threaded interface being configured to couple to a threaded outlet of the flush valve housing of the tankless toilet;

said male threaded interface being configured to couple to the vacuum breaker member;

said outlet port member being configured to couple to a conduit.

2. The flush valve adapter as claimed in claim 1, wherein said outlet port member includes a one-way valve mechanism configured to allow fluid to only flow from said conduit body.

3. The flush valve adapter as claimed in claim 1, wherein said outlet port member includes a metering mechanism configured to meter an amount of fluid leaving said conduit body.

4. The flush valve adapter as claimed in claim 1, wherein said outlet port member is integral to said conduit body.

5. A vacuum breaker adapter for a tankless toilet having a flush valve housing, comprising:

a conduit body having a first end and a second end;

a female threaded interface located at said first end of said conduit body;

a vacuum breaker mechanism located in said conduit body;

an inlet port member located on said conduit body downstream of said vacuum breaker mechanism; and a cleaning agent mixing chamber interface member located on said conduit body between said first end and said second end;

said inlet port member being configured to couple to a conduit;

said cleaning agent mixing chamber interface member being configured to securely attach a cleaning agent mixing chamber thereto.

6. The vacuum breaker adapter as claimed in claim 5, wherein said inlet port member includes a one-way valve mechanism configured to allow fluid to only flow into said conduit body.

7. The vacuum breaker adapter as claimed in claim 5, wherein said inlet port member includes a metering mechanism configured to meter an amount of fluid entering said conduit body.

8. The vacuum breaker adapter as claimed in claim 5, wherein said inlet port member is integral to said conduit body.

9. The vacuum breaker adapter as claimed in claim 5, further comprising:

an outlet port located on said conduit body upstream of said vacuum breaker mechanism;

said outlet port member being configured to couple to a conduit.

10. The vacuum breaker adapter as claimed in claim 9, wherein said inlet port member includes a one-way valve mechanism configured to allow fluid to only flow into said conduit body.

11. The vacuum breaker adapter as claimed in claim 9, wherein said inlet port member includes a metering mechanism configured to meter an amount of fluid entering said conduit body.

12. The vacuum breaker adapter as claimed in claim 9, wherein said inlet port member is integral to said conduit body.

13. The flush valve adapter as claimed in claim 9, wherein said outlet port member includes a one-way valve mechanism configured to allow fluid to only flow from said conduit body.

14. The flush valve adapter as claimed in claim 9, wherein said outlet port member includes a metering mechanism configured to meter an amount of fluid leaving said conduit body.

15. The flush valve adapter as claimed in claim 9, wherein said outlet port member is integral to said conduit body.

16. A cleaning agent dispensing system for a tankless toilet having a flush valve housing, comprising:

a flush valve adapter;

a vacuum breaker adapter;

a first conduit;

a second conduit; and a cleaning agent dispensing member;

said flush valve adapter including a flush valve adapter conduit body having a first end and a second end, a flush valve adapter female threaded interface located at said first end of said flush valve adapter conduit body, a flush valve adapter male threaded interface located at said second end of said flush valve adapter conduit body, and an outlet port member located in said flush valve adapter conduit body between said flush valve adapter female threaded interface and said flush valve adapter male threaded interface;

said vacuum breaker adapter including a vacuum breaker adapter conduit body having a first end and a second end, a vacuum breaker adapter female threaded interface located at said first end of said vacuum breaker adapter conduit body, a vacuum breaker mechanism located at said first end of said vacuum breaker adapter conduit body, an inlet port member located in said vacuum breaker adapter conduit body between said vacuum breaker mechanism and said second end of said vacuum breaker adapter conduit body, and a cleaning agent mixing chamber interface member located on said vacuum breaker adapter conduit body between said vacuum breaker mechanism and said inlet port member;

said flush valve adapter female threaded interface being configured to couple to a threaded outlet of the flush valve housing of the tankless toilet;

said flush valve adapter male threaded interface being configured to couple to said vacuum breaker adapter;

said outlet port member being configured to couple to said first conduit;

said inlet port member being configured to couple to said second conduit.

17. The cleaning agent dispensing system as claimed in claim 16, wherein said inlet port member includes a one-way valve mechanism configured to allow fluid to only flow into said vacuum breaker adapter conduit body.

18. The cleaning agent dispensing system as claimed in claim 16, wherein said inlet port member includes a metering mechanism configured to meter an amount of fluid entering said vacuum breaker adapter conduit body.

19. The cleaning agent dispensing system as claimed in claim 16, wherein said outlet port member includes a one-way valve mechanism configured to allow fluid to only flow from said flush valve adapter conduit body.

20. The cleaning agent dispensing system as claimed in claim 16, wherein said outlet port member includes a metering mechanism configured to meter an amount of fluid leaving said flush valve adapter conduit body.

21. The cleaning agent dispensing system as claimed in claim 16, wherein said first conduit includes a trap.

22. The cleaning agent dispensing system as claimed in claim 16, wherein said cleaning agent dispensing member includes:

a cleaning agent mixing chamber configured to mix water received from said flush valve adapter conduit body with a cleaning agent tablet; and a tablet cradle configured to hold a cleaning agent tablet within said transparent cleaning agent mixing chamber.

23. The cleaning agent dispensing system as claimed in claim 22, wherein said tablet cradle includes:

a housing; and multiple apertures, in said housing, configured to allow water to flow therethrough.

24. The cleaning agent dispensing system as claimed in claim 23, wherein said tablet cradle includes multiple tablet shelves, having apertures therein, configured to hold multiple cleaning agent tablets within said cleaning agent mixing chamber.

25. The cleaning agent dispensing system as claimed in claim 22, wherein said cleaning agent mixing chamber has a transparent wall.

26. The cleaning agent dispensing system as claimed in claim 16, wherein said cleaning agent dispensing member includes:

a transparent cleaning agent mixing chamber configured to mix water received from said flush valve adapter conduit body with a cleaning agent tablet; and a tablet cradle configured to hold a cleaning agent tablet within said transparent cleaning agent mixing chamber.

27. The cleaning agent dispensing system as claimed in claim 26, wherein said tablet cradle includes:

a housing;

multiple apertures, in said housing, configured to allow water to flow therethrough, and a three-dimensional opening, in said housing, configured to enable a substantially unobstructed view of a cleaning agent tablet within said transparent cleaning agent mixing chamber.

28. The cleaning agent dispensing system as claimed in claim 27, wherein said tablet cradle includes multiple tablet shelves, having apertures therein, configured to hold multiple cleaning agent tablets within said cleaning agent mixing chamber.

* * * * *